US010810863B2

(12) United States Patent
Marlatt et al.

(10) Patent No.: US 10,810,863 B2
(45) Date of Patent: Oct. 20, 2020

(54) DISTRIBUTED SECURITY SYSTEM OVER MULTIPLE SITES

(71) Applicant: Avigilon Corporation, Vancouver (CA)

(72) Inventors: Shaun P. Marlatt, Vancouver (CA); Avery W. Chiang, Vancouver (CA); Tomer Goldenberg, Vancouver (CA); Matthew J. Adam, Vancouver (CA); Jonathon E. B. Grieman, Vancouver (CA)

(73) Assignee: AVIGILON CORPORATION, Vancouver (CA)

( * ) Notice: Subject to any disclaimer, the term of this patent is extended or adjusted under 35 U.S.C. 154(b) by 0 days.

(21) Appl. No.: 14/884,587

(22) Filed: Oct. 15, 2015

(65) Prior Publication Data

US 2016/0110993 A1 Apr. 21, 2016

Related U.S. Application Data

(60) Provisional application No. 62/064,368, filed on Oct. 15, 2014.

(51) Int. Cl.
*G08B 26/00* (2006.01)
*G08B 13/196* (2006.01)

(52) U.S. Cl.
CPC ..... *G08B 26/004* (2013.01); *G08B 13/1968* (2013.01); *G08B 13/19656* (2013.01); *G08B 13/19682* (2013.01)

(58) Field of Classification Search
None
See application file for complete search history.

(56) References Cited

U.S. PATENT DOCUMENTS

| | | | | |
|---|---|---|---|---|
| 2002/0174331 | A1* | 11/2002 | Nock | G06F 9/44505 713/100 |
| 2005/0021309 | A1 | 1/2005 | Alexander et al. | |
| 2006/0092010 | A1 | 5/2006 | Simon et al. | |
| 2008/0052774 | A1* | 2/2008 | Chesla | G06F 21/552 726/13 |
| 2010/0145899 | A1 | 6/2010 | Buehler | |
| 2010/0274366 | A1 | 10/2010 | Fata et al. | |
| 2014/0074987 | A1 | 3/2014 | Martz et al. | |
| 2014/0222892 | A1 | 8/2014 | Lee et al. | |

OTHER PUBLICATIONS

IBM; "What is distributed computing", Dec. 18, 2005, https://www.ibm.com/support/knowledgecenter/en/SSAL2T_8.2.0/com.ibm.cics.tx.doc/concepts/c_wht_is_distd_comptg.html (Year: 2005).*

Insup Lee, "Introduction to Distributed Systems", 2007, Department of Computer and Information Science, University of Pennsylvania (Year: 2007).*

(Continued)

*Primary Examiner* — Daniell L Negron
(74) *Attorney, Agent, or Firm* — BakerHostetler

(57) ABSTRACT

A physical security system may define sites associated with cameras. Sites may be added as a child site off of a parent site to form a site family. Once set up, ranked user and group privileges on the parent site may be pushed to the child sites, and controlled by the parent site. The child sites may still define local users and groups so that the child site may operate if there is a loss of connectivity to the parent site.

29 Claims, 21 Drawing Sheets

(56) References Cited

OTHER PUBLICATIONS

Distributed Computing: Utilities, Grids & Clouds, 2009, ITU-T Technology Watch Report 9 (Year: 2009).*
International Patent Application No. PCT/US2015/055822; Int'l Preliminary Report on Patentability; dated Apr. 27, 2017; 8 pages.
International Patent Application No. PCT/US2015/55822; Int'l Search Report and the Written Opinion; dated Jan. 6, 2016; 14 pages.
Almeida et al.; "Interval Tree Clocks: A Logical Clock for Dynamic Systems"; Principles of Distributed Systems; 2008; vol. 5401; 13 pages.
Agarwal et al.; "The Totem Multiple-Ring Ordering and Topology Maintenance Protocol"; ACM Transactions on Computer Systems; May 1998; vol. 16 No. 2; p. 93-132.

* cited by examiner

DISTRIBUTED SECURITY SYSTEM OVER MULTIPLE SITES

BACKGROUND

A physical security system is a system that implements measures to prevent unauthorized persons from gaining physical access to an asset, such as a building, a facility, or confidential information. Examples of physical security systems include surveillance systems, such as a system in which cameras are used to monitor the asset and those in proximity to it; access control systems, such as a system that uses RFID cards to control access to a building; intrusion detection systems, such as a home, or building burglary alarm system; and combinations of the foregoing systems.

A physical security system often incorporates computers. As this type of physical security system grows, the computing power required to operate the system increases. For example, as the number of cameras in a surveillance system increases, the requisite amount of computing power also increases to allow additional video to be stored and to allow simultaneous use and management of a higher number of cameras. The control and protection of such computers and the physical security system as a whole is an important issue.

SUMMARY

A physical security system may define sites associated with security cameras, access control panels, sensor control monitors, or other such similar monitoring devices. A site may include a number of nodes which may be synchronized. A site may be configured to be a parent site, and multiple sites may be communicatively coupled with this parent site to form a "site family", also referred to as a "Site Family". In a configured Site Family, ranked user and group privileges on the parent site may be pushed to the child sites, and controlled by the parent site. The child sites may still define local users and groups so that the child site may operate if there is a loss of connectivity to the parent site.

Server nodes/storage nodes/cameras/devices may be grouped into a site with a set of users that have credentials to access devices across that site. A site may be within a single locale such as within a building secured with physical security products. A site may include a cluster of servers that provides for redundancy. A Site Family may be a group of sites, such as multiple buildings that need not be close to each other, collectively referred to as "Site Families". Site Families may allow hierarchical and grouped user credentials with grouped access privileges or attributes.

The security personnel that operate each site are different, and may be managed or trusted differently. The Site families feature may provide the ability for a "parent site" to manage the credentials of each site in the family differently, applying or changing attributes across all members in a site without applying or changing attributes of other sites. The concept of "rank" may determine which users may modify the credentials (or attributes of credentials) of other users.

In addition, configuration may be provided from the parent sites to child sites. This configuration may include rules, alerts, users and groups, network endpoints for remote access, default device settings, default recording schedules, and other system defaults. This may reduce the time required to manually set up the configuration at the child site. Child site configuration may also be backed-up to the parent site for disaster recovery and easy replacement of sites or servers.

Hierarchical access credentials may be used for physical security systems where the parent sites allow for greater control. A distributed credentials database may be synchronized such that a local site may reliably continue operating despite long periods of network failure or disconnectivity between sites. A tree-structured hierarchy of users may be displayed on a Graphical User Interface (GUI) with the ability to add and remove child sites.

The sites (including child sites) may comprise nodes that are communicatively coupled and capable of executing programs described herein and non-node devices, sensors, and actuators associated with and managed by those nodes. Nodes may be general purpose computers, cameras, access control panels, network switches, or any other capable devices. Nodes may be communicatively coupled with and manage other (non-node) devices such as cameras, access control panels, motion sensors, point of sale transaction sources, sensors, or other such devices that are not capable of executing programs described herein. A distributed site management system can facilitate the management of surveillance systems, access control systems, and hybrid video and access control systems.

This summary does not necessarily describe the entire scope of all aspects. Other aspects, features and advantages will be apparent to those of ordinary skill in the art upon review of the following description of specific embodiments.

DETAILED DESCRIPTION OF ILLUSTRATIVE EMBODIMENTS

"Security Software" may be a software platform that may be installed onto any network hardware with the capability to run a software program. Examples of such hardware are Network Video Recorders (NVRs), switches, and IP cameras. Another example of such hardware are switches, access control panels, proximity readers, smart card readers, fingerprint readers and mag-stripe readers. When installed on the network hardware, the security software platform may organize the devices into logical systems capable of performing application specific tasks.

Hardware systems (a collection of sensors, cameras, NVRs, and switches) may be organized into video management systems. Other applications, such as business intelligence and access control may also be supported. These applications may be supported simultaneously on the same platform, making more efficient use of hardware resources.

FIGS. 1-9 describe an example distributed security system within a site with multiple nodes. FIGS. 10-20 illustrate a distributed security system between multiple sites.

Figure 1:
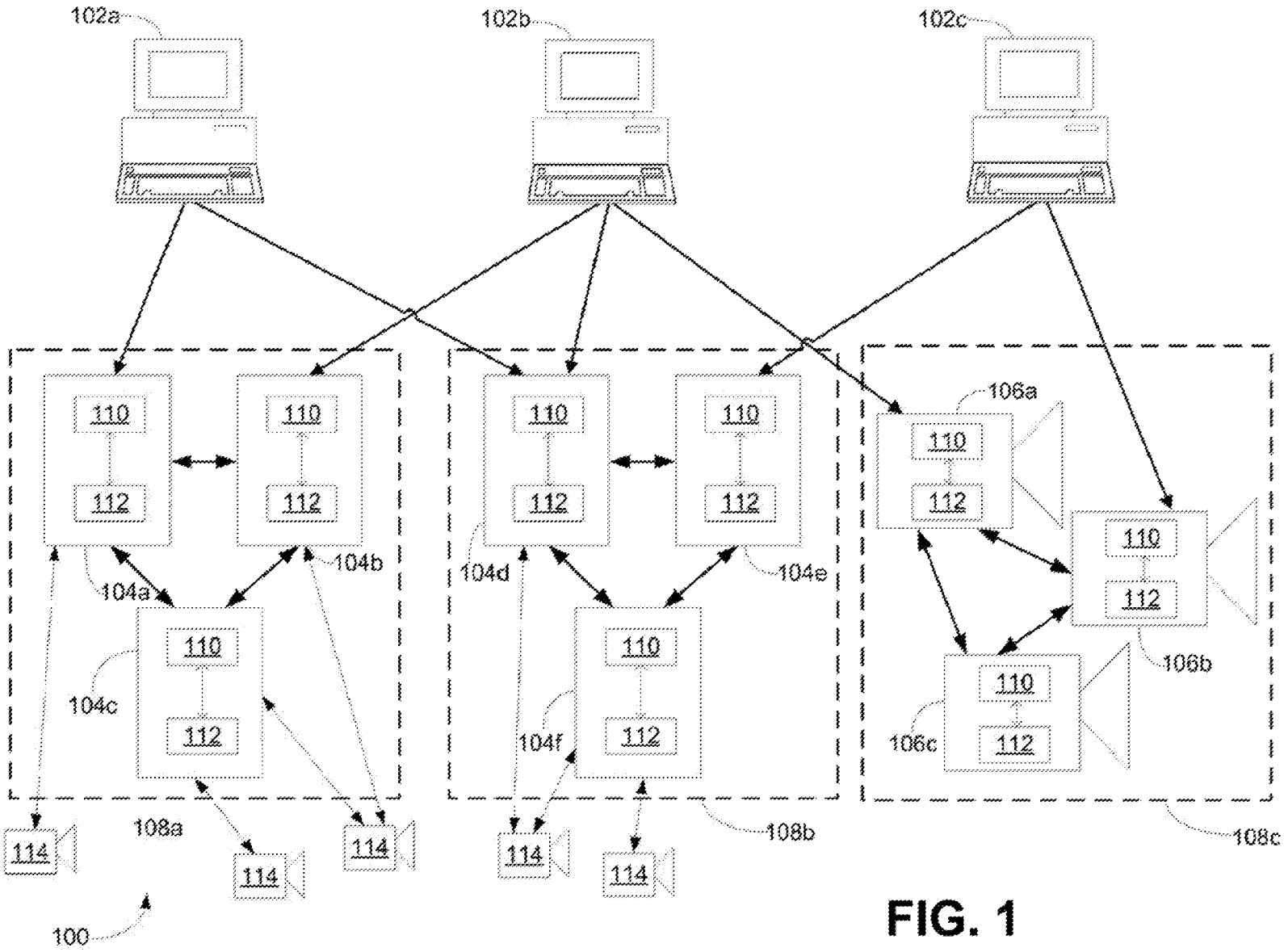
FIG. 1 is a diagram that illustrates an exemplary system with sites having a number of nodes.

FIG. 1 shows a distributed physical security system in the form of a surveillance system 100, according to one embodiment. The system 100 includes three clients 102*a-c* (first client 102*a* to third client 102*c* and collectively "clients 102"), six servers 104*a-f* (first server 104*a* to sixth server 104*f* and collectively "servers 104"), three server node cameras 106*a-c* (first node camera 106*a* to third node camera 106*c* and collectively "node cameras 106"); and five non-node cameras 114.

Each of the node cameras 106 and servers 104 includes a processor 110 and a memory 112 that are communicatively coupled to each other, with the memory 112 having encoded thereon statements and instructions to cause the processor 110 to perform any embodiments of the methods described herein. The servers 104 and node cameras 106 are grouped into three sites 108*a-c* (collectively "sites 108"): the first through third servers 104*a-c* are communicatively coupled to each other to form a first site 108*a*; the fourth through sixth servers 104*d-f* are communicatively coupled to each other to form a second site 108*b*; and the three node cameras 106 are communicatively coupled to each other to form a third site 108*c*. The first through third servers 104*a-c* are referred to as "members" of the first site 108*a*; the fourth through sixth servers 104*d-f* are referred to as "members" of the second site 108*b*; and the first through third node cameras 106*a-c* are referred to as "members" of the third site 108*c*. Other sensors other than cameras 106 and 114 may also be associated with nodes and sites.

Servers 104 and node cameras 106 are "server nodes" in that each is aware of the presence of the other members of its site 108 and can send data to the other members of its site 108; in contrast, the non-node cameras 114 are not server nodes in that they are aware only of the servers 104*a-f* to which they are directly connected. In the depicted embodiment, the server nodes are aware of all of the other members of the site 108 by virtue of having access to site membership information, which lists all of the server nodes in the site 108. The site membership information is stored persistently and locally on each of the server nodes, which allows each of the server nodes to automatically rejoin its site 108 should it reboot during the system 100's operation.

The various sites 108 may share data with each other as described below. In the depicted embodiment, the servers 104 are commercial off-the-shelf servers and the cameras 106, 114 are manufactured by Avigilon™ Corporation of Vancouver, Canada; however, in alternative embodiments, other suitable types of servers 108 and cameras 106, 114 may be used.

Each of the nodes may run services that allow each of the nodes to communicate with each other according to a protocol suite to allow any one node to share data, whether that data be views, video, system events, user states, user settings, or another kind of data, to any other node using distributed computing, i.e., without using a centralized server. Each of the nodes may have access to site membership information that identifies all the nodes that form part of the same site 108; by accessing this site membership information, data can be shared and synchronized between all the nodes of a site 108.

The nodes/servers 104 are associated with sensors such as cameras 114. A site 108 may be a distributed physical security system, such as a surveillance system, that may automatically share data such as views, video, system events, user states, and user settings between two or more nodes 104*a-c* in the system without relying on a centralized server such as a gateway or management servers. Users may connect via clients 102*a-b* to the nodes 104*a-c* to access network video recorders and cameras. Each of nodes 104*a-c* in the site 108*a* may be able to share data with the other server nodes in the site. To share this data, each of the nodes 104*a-c* may run services that exchange data based on a protocol suite that shares data between the nodes in different ways depending on whether the data represents views, video, system events, user states, or user settings.

Each node 104*a-c* in the designated site may be capable of hosting a front-end that models the site as a single logical entity to connected clients. A client only needs to have connectivity with any single node in the site to use all functionality in the site as node-node service and data routing are supported.

Sites may be assumed to logically model a set of devices co-located at a single physical location. For example, a store, airport, casino, or a corporation headquarters.

Figure 2:
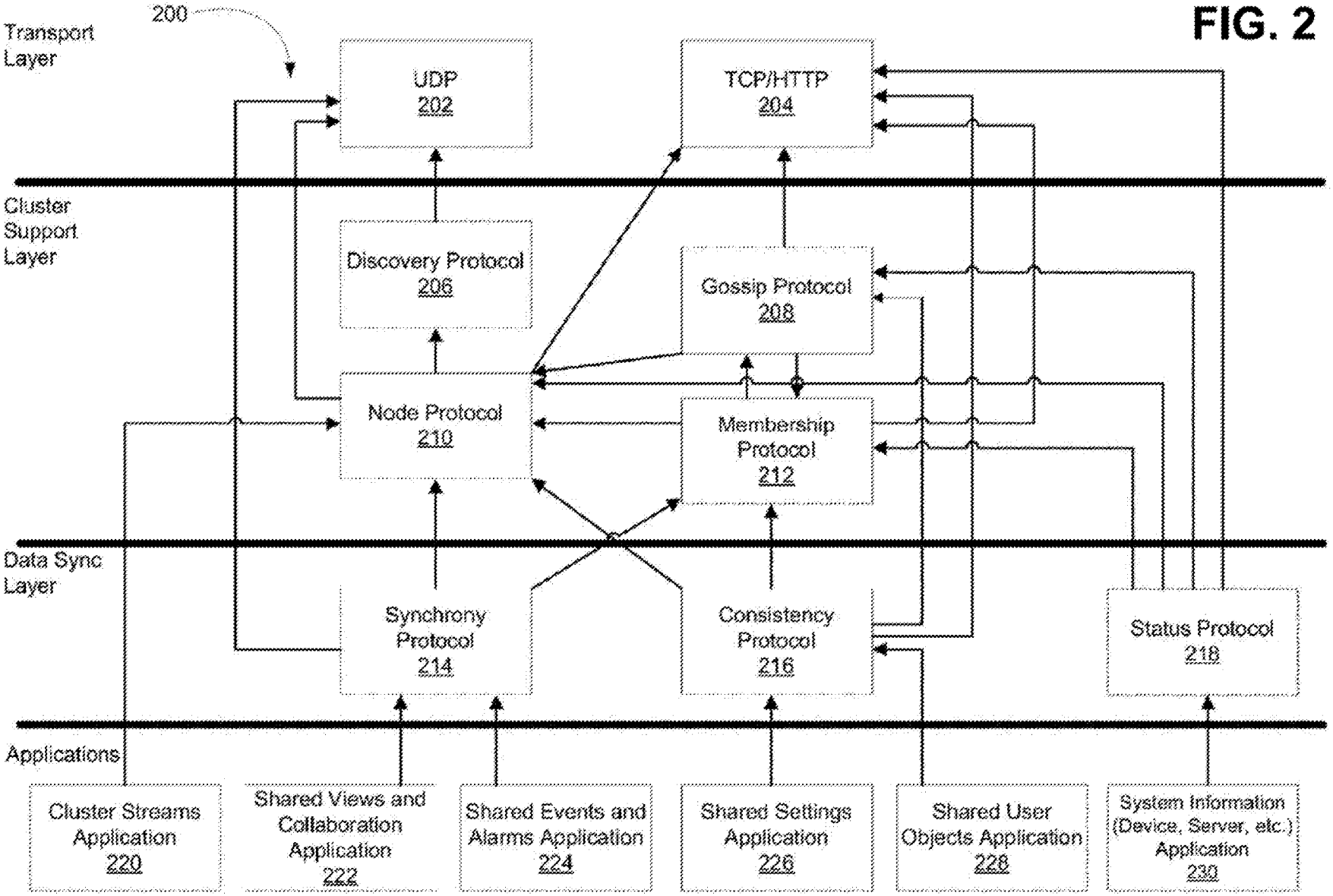
FIG. 2 is a block diagram of an exemplary protocol suite for the system of FIG. 1.

FIG. 2 shows a block diagram of the protocol suite 200 employed by the nodes of the system 100. The protocol suite 200 is divided into three layers and includes the following protocols, as summarized in Table 1:

TABLE 1

Summary of the Protocol Suite 200

| Protocol Name | Protocol Layer | Receives Data from these Protocols and Applications | Sends Data to these Protocols |
|---|---|---|---|
| UDP 202 | transport | discovery protocol 206, node protocol 210, synchrony protocol 214 | n/a |

TABLE 1-continued

| Summary of the Protocol Suite 200 | | | |
|---|---|---|---|
| Protocol Name | Protocol Layer | Receives Data from these Protocols and Applications | Sends Data to these Protocols |
| TCP/HTTP 204 | transport | node protocol 210, gossip protocol 208, membership protocol 212, consistency protocol 216, status protocol 218 | n/a |
| discovery protocol 206 | cluster support | node protocol 210 | UDP 202 |
| gossip protocol 208 | cluster support | membership protocol 212, consistency protocol 216, status protocol 218 | TCP/HTTP 204, node protocol 210, membership protocol 212 |
| node protocol 210 | cluster support | cluster streams application 220, synchrony 214, consistency protocol 216, membership protocol 212, status protocol 218, gossip protocol 208 | UDP 202, TCP/HTTP 204, discovery protocol 206 |
| membership protocol 212 | cluster support | synchrony protocol 214, gossip protocol 208, status protocol 218, consistency protocol 216 | gossip protocol 208, node protocol 210, TCP/HTTP 204 |
| synchrony protocol 214 | data sync | shared views and collaboration application 222, shared events and alarms application 224 | UDP 202, node protocol 210, membership protocol 212 |
| consistency protocol 216 | data sync | shared settings application 226, shared user objects application 228 | node protocol 210, membership protocol 212, gossip protocol 208, TCP/HTTP 204 |
| status protocol 218 | data sync | system information application 230 | gossip protocol 208, membership protocol 212, node protocol 210, TCP/HTTP 204 |

A description of the function and operation of each of the protocols in the protocol suite 200 follows.

Transport Layer

The Transport Layer corresponds to layer 4 of the Open Systems Interconnection (OSI) model, and is responsible for providing reliable data transfer services between nodes to the site support, data synchronization, and application layers. The Transport Layer in the system 100 includes the UDP 202 and TCP/HTTP 204 protocols.

Site Support Layer

The Site Support Layer (also known as "cluster support layer") includes the protocols used to discover nodes, verify node existence, check node liveliness, determine whether a node is a member of one of the sites 108, and determine how to route data between nodes.

1. Discovery Protocol 206

The discovery protocol 206 is based on version 1.1 of the WS-Discovery protocol published by the Organization for the Advancement of Structured Information Standards (OASIS), the entirety of which is hereby incorporated by reference herein. In the depicted embodiment, XML formatting used in the published standard is replaced with Google™ Protobuf encoding.

The discovery protocol 206 allows any node in the system 100 to identify the other nodes in the system 100 by multicasting Probe messages to those other nodes and waiting for them to respond. A node may alternatively broadcast a Hello message when joining the system 100 to alert other nodes to its presence without requiring those other nodes to first multicast the Probe message. Both the Probe and Hello messages may be modeled on the WS-discovery protocol published by OASIS.

2. Gossip Protocol 208

The gossip protocol 208 is an epidemic protocol that disseminates data from one of the nodes to all of the nodes of a site 108 by randomly performing data exchanges between pairs of nodes in the site 108. The gossip protocol 208 communicates liveliness by exchanging "heartbeat state" data in the form of a heartbeat count for each node, which allows nodes to determine when one of the nodes in the site 108 has left unexpectedly (e.g., due to a server crash). The gossip protocol 208 also communicates "application state" data such as top-level hashes used by the consistency protocol 216 and status entity identifiers and their version numbers used by the Status protocol 218 to determine when to synchronize data between the nodes, as discussed in more detail below. The data spread using the gossip protocol 208 eventually spreads to all of the nodes in the site 108 via periodic node to node exchanges.

A data exchange between any two nodes of the site 108 using the gossip protocol 208 involves performing two remote procedure calls (RPCs) from a first node ("node A")

to a second node ("node B") in the same site 108, as described below. The following process may be applied on a node or site level, where a node may represent an individual device or network entity, and a site may represent or include multiple nodes, for example, at a specific physical location or in a logical group that may not correlate to a single physical location. In some cases, a node may refer to a site and vice versa. In one example, the data exchange includes:

1. Node A sends a GreetingReq message to node B, which contains a list of digests for all the nodes in the site 108 of which node A is aware. For each node, a digest includes a unique node identifier and version information that is incremented each time either the heartbeat state or application state for that node changes (e.g., via a heartbeat RPC sent from a child site to a parent site that indicates to the parents site that the child site is still online). The version information may be, for example, a one-dimensional version number or a multi-dimensional version vector. Using a version vector allows the digest to summarize the history of the state changes that the node has undergone.
2. Node B sends a GreetingRsp message to node A, which contains:
   a. a list of digests for nodes about which node B wishes to receive more information from node A, which node B determines from the version information sent to it in the GreetingReq message;
   b. a list of digests for nodes about which node A does not know that form part of the site 108;
   c. a list of one or both of heartbeat and application states that will bring node A up-to-date on nodes for which it has out-of-date information; and
   d. a list of nodes that node A believes form part of the site 108 but that node B knows have been removed from the site 108.
3. Node A then sends a ClosureReq message to node B, in which node A sends:
   a. (a) a list of digests for nodes about which node A wishes to receive more information from node B (e.g. node A may request information for nodes of which node A was unaware until node B sent node A the GreetingRsp message);
   b. (b) a list of states that will bring node B up-to-date on nodes for which it has out-of-date information; and
4. (c) a list of nodes that node B believes form part of the site 108 but that node A knows have been removed from the site 108.
5. Node B then sends a ClosureRsp message to node A, in which node B sends:
   a. a list of states that will bring node A up-to-date on nodes it is out-of-date on, in response to node A's request in ClosureReq; and
   b. a list of nodes that have been removed from the site 108 since GreetingRsp.

After nodes A and B exchange RPCs, they will have identical active node lists, which include the latest versions of the heartbeat state and application state for all the nodes in the site 108 that both knew about before the RPCs and that have not been removed from the site 108.

3. Node Protocol 210

The node protocol 210 is responsible for generating a view of the system 100's network topology for each node, which provides each node with a network map permitting it to communicate with any other node in the system 100. In some embodiments, the network map is a routing table. The network map references communication endpoints, which are an address (IP/FQDN), port number, and protocol by which a node can be reached over the IP network that connects the nodes.

The node protocol 210 does this in three ways:

1. via a "Poke exchange", as described in further detail below;
2. via the discovery protocol 206, which notifies the node protocol 210 when a node joins or leaves the system 100. When a node joins the system 100 a "Poke exchange" is performed with that node; and
3. manually, in response to user input.

A Poke exchange involves periodically performing the following RPCs for the purpose of generating network maps for the nodes:

1. a Poke request, in which node A sends to node B a node A self view and a list of other nodes known to node A, as viewed by node A, following which node B updates its network map in view of this information; and
2. a Poke response, in which node B sends to node A a node B self view and a list of other nodes known to node B, as viewed by node B, following which node A updates its network map in view of this information.

In some aspects, the RPCs are performed over the TCP/HTTP protocol 204. To reduce bandwidth usage, node information may only be exchanged between nodes A and B if the node information has changed since the last time it has been exchanged.

A Poke exchange is performed after the discovery protocol 206 notifies the node protocol 210 that a node has joined the system 100 because the discovery protocol 206 advertises a node's communication endpoints, but does not guarantee that the node is reachable using those communication endpoints. For example, the endpoints may not be usable because of a firewall. Performing a Poke exchange on a node identified using the discovery protocol 206 confirms whether the communication endpoints are, in fact, usable.

The node protocol 210 can also confirm whether an advertised UDP communication endpoint is reachable; however, the node protocol 210 in the depicted embodiment does not perform a Poke exchange over the UDP protocol 202.

For any given node in a site 108, a network map relates node identifiers to communication endpoints for each of the nodes in the same site 108. Accordingly, the other protocols in the protocol stack 200 that communicate with the node protocol 210 can deliver messages to any other node in the site 108 just by using that node's node identifier.

4. Membership Protocol 212

The Membership protocol 212 is responsible for ensuring that each node of a site 108 maintains site membership information for all the nodes of the site 108, and to allow nodes to join and leave the site 108 via RPCs. Site membership information is shared between nodes of the site 108 using the Status protocol 218. Each node in the site 108 maintains its own version of the site membership information and learns from the Status protocol 218 the site membership information held by the other nodes in the site 108. As discussed in further detail below, the versions of site membership information held by two different nodes may not match because the version of site membership information stored on one node and that has been recently updated may not yet have been synchronized with the other members of the site 108.

For each node, the site membership information includes:

1. A membership list of all the nodes of the site 108, in which each of the nodes is represented by:

(a) the node identifier, which is unique among all the nodes in the system 100;

(b) the node's state, which is any one of:

i. Discover: the node is a member of the site 108 but has not been synchronized with the other members of the site 108 since having booted;

ii. Joining: the node is in the process of joining a site 108;

iii. Syncing: the node is in the process of synchronizing data using the Synchrony, Consistency, and Status protocols 214, 216, 218 with the site 108 it has just joined;

iv. Valid: the node has completed synchronizing the site membership information and is a valid node of the site 108; and v. TimedOut: the node has become unresponsive and is no longer an active member of the site 108 (the node remains a member of the site 108 until removed by a user);

(c) a session token;

(d) the version number of the site membership information when the node joined the site 108; and i. e) the version number of the site membership information the last time it was changed.

2. A gravestone list listing all the nodes that have been removed from the site 108, in which each removed node is represented by:

(a) that node's node identifier; and (b) the version of that node's site membership information when the node was removed.

In the depicted embodiment, a node is always a member of a site 108 that comprises at least itself; a site 108 of one node is referred to as a "singleton site". Furthermore, while in the depicted embodiment, the membership information includes the membership list and gravestone list as described above, in alternative embodiments (not depicted) the membership information may be comprised differently; for example, in one such alternative embodiment, the membership information lacks a gravestone list, while in another such embodiment the node's state may be described differently than described above.

When node A wants to act as a new server node and wants to join a site 108 that includes node B, it communicates with node B and the following occurs:

1. Node A sends a site secret to node B, which in the depicted embodiment is a key that node B requires before letting another node join its site 108. One of the clients 102 provides the site secret to node A. As node B controls node A's access to the site 108, node B acts as a "membership control node".
2. Nodes A and B exchange their membership information. The versions of the membership information on nodes A and B are updated to include the node identifiers of node A and of all the nodes of the site 108 that node A is joining
3. Node A's state is changed to "Joining" as node A joins the site.
4. Once joined, node A's state is changed to "Syncing" as data is exchanged between node A and the site 108 it has just joined. Node B also updates the version of the membership information stored on all the other nodes of the site 108 using the Status protocol 218. The process of updating the versions of the membership information stored on node A and all the members of the site 108 that node A is joining is referred to as "synchronizing" the versions of the membership information stored on all of these nodes.
5. After synchronization is complete, node A's state changes to Valid.

Data Synchronization Layer

The Data Synchronization Layer includes the protocols that enable data to be sent between the nodes in a site with different ordering guarantees and performance tradeoffs. The protocols in the Data Synchronization Layer directly use protocols in the Transport and Site Support Layers.

1. Synchrony Protocol 214

The synchrony protocol 214 is used to send data in the form of messages from node A to node B in the system 100 such that the messages arrive at node B in an order that node A can control, such as the order in which node A sends the messages. Services that transfer data using the synchrony protocol 214 run on dedicated high priority I/O service threads.

In the depicted embodiment, the synchrony protocol 214 is based on an implementation of virtual synchrony known as the totem protocol, as described in Agarwal D A, Moser L E, Melliar-Smith P M, Budhia R K, "The Totem Multiple-Ring Ordering and Topology Maintenance Protocol", ACM Transactions on Computer Systems, 1998, pp. 93-132, the entirety of which is hereby incorporated by reference herein. In the synchrony protocol 214, nodes are grouped together into groups referred to hereinafter in this description as "synchrony rings", and a node on any synchrony ring can send totally ordered messages to the other nodes on the same ring. The synchrony protocol 214 modifies the totem protocol as follows:

1. The synchrony protocol 214 uses both a service identifier and a ring identifier to identify a synchrony ring. The service identifier identifies all instances of a given synchrony ring, whereas the ring identifier identifies a particular instance of a given synchrony ring. For example, each time a node joins or leaves a synchrony ring that ring's ring identifier will change, but not its service identifier. The service identifier allows a node to multicast totally ordered messages to the group of nodes that share the same service identifier (i.e. the group of nodes that belong to the same synchrony ring).
2. In the totem protocol, in some cases when the nodes are not sending messages the synchrony ring seen by nodes does not reflect the final ring configuration that converges when the nodes begin messaging. The synchrony protocol 214 allows nodes to send probe messages to each other to cause synchrony rings to converge prior to the sending of non-probe messages.
3. The totem protocol only allows ordered messages to be sent to all nodes that form part of a synchrony ring. In contrast, the synchrony protocol 214 uses a Dispatch module that abstracts the network layer from the synchrony protocol 214 by providing an interface to broadcast to all reachable nodes in the system 100; multicast to any set of nodes in the system 100 using a list of destination node identifiers; and to unicast to a single node in the system 100 using its node identifier. The Dispatch module also supports multiplexing of services on the same IP port using message filtering and routing by service identifier. Outgoing messages from a node are sent to the subset of nodes having the same service identifier unless multicast.
4. The synchrony protocol 214 uses fragmented messages and user payload chunking and coalescing to address problems arising from the maximum transmission unit size of approximately 1,500 bytes.

5. The synchrony protocol 214 modifies the way nodes use Join messages, which are messages nodes use in the totem protocol to join a synchrony ring:
   a. Join messages are sent by nodes only if they have the lowest node identifier in the current set of operational nodes in the synchrony ring.
   b. Nodes that do not have the lowest node identifier in their operational set unicast Join messages to the nodes with the lowest node identifier in their operational set.
   c. Join messages include the service identifier, and nodes that are not part of the corresponding synchrony ring do not respond. Relative to the totem protocol, these modifications help reduce aggregate bandwidth used by nodes to join synchrony rings.
6. The synchrony protocol 214 detects and blacklists nodes that are unable to join a synchrony ring due to some types of network misconfigurations. For example, a node that is able to send to, but not receive messages from, the other nodes will appear to the other nodes to only ever send probe messages since all other messages in the present embodiment are solicited, and accordingly will be blacklisted.
7. The synchrony protocol 214 performs payload encryption and authenticity verification of messages.
8. The synchrony protocol 214 limits the time each node can hold the token used in the totem protocol; in the depicted embodiment, each node can hold the token for 15 ms.
9. The synchrony protocol 214 implements a TCP friendly congestion avoidance algorithm.

As discussed in more detail below, the system 100 uses the synchrony protocol 214 for the Shared Views and Collaboration application 222 and the Shared Events and Alarms application 224; the data shared between members of a site 108 in these applications 222 is non-persistent and is beneficially shared quickly and in a known order.

2. Consistency Protocol 216

The consistency protocol 216 is used to automatically and periodically share data across all the nodes of a site 108 so that the data that is shared using the consistency protocol 216 is eventually synchronized on all the nodes in the site 108. The types of data that are shared using the consistency protocol 216 are discussed in more detail below in the sections discussing the shared settings application 226 and the shared user objects application 228. Data shared by the consistency protocol 216 is stored in a database on each of the nodes, and each entry in the database includes a key-value pair in which the key uniquely identifies the value and the keys are independent from each other. The consistency protocol 216 synchronizes data across the nodes while resolving parallel modifications that different nodes may perform on different databases. As discussed in further detail below, the consistency protocol 216 accomplishes this by first being notified that the databases are not synchronized; second, finding out which particular database entries are not synchronized; and third, finding out what version of the entry is most recent, synchronized, and kept.

In order to resolve parallel modifications that determine when changes are made to databases, each node that joins a site 108 is assigned a causality versioning mechanism used to record when that node makes changes to data and to determine whether changes were made before or after changes to the same data made by other nodes in the site 108. In the present embodiment, each of the nodes uses an interval tree clock (ITC) as a causality versioning mechanism. However, in alternative embodiments other versioning mechanisms such as vector clocks and version vectors can be used. The system 100 also implements a universal time clock (UTC), which is synchronized between different nodes using network time protocol, to determine the order in which changes are made when the ITCs for two or more nodes are identical. ITCs are described in more detail in P. Almeida, C. Baquero, and V. Fonte, "Interval tree clocks: a logical clock for dynamic systems," Princi. Distri. Sys., Lecture Notes in Comp. Sci., vol. 5401, pp. 259-274, 2008, the entirety of which is hereby incorporated by reference herein.

The directory that the consistency protocol 216 synchronizes between nodes is divided into branches, each of which is referred to as an Eventual Consistency Domain (ECD). The consistency protocol 216 synchronizes each of the ECDs independently from the other ECDs. Each database entry within an ECD is referred to as an Eventual Consistency Entry (ECE). Each ECE includes a key; a timestamp from an ITC and from the UTC, which are both updated whenever the ECE is modified; a hash value of the ECE generating using, for example, a Murmurhash function; the data itself; and a gravestone that is added if and when the ECE is deleted.

The hash value is used to compare corresponding ECDs and ECEs on two different nodes to determine if they are identical. When two corresponding ECDs are compared, "top-level" hashes for those ECDs are compared. A top-level hash for an ECD on a given node is generated by hashing all of the ECEs within that ECD. If the top-level hashes match, then the ECDs are identical; otherwise, the consistency protocol 216 determines that the ECDs differ. To determine which particular ECEs in the ECDs differ, hashes are taken of successively decreasing ranges of the ECEs on both of the nodes. The intervals over which the hashes are taken eventually shrinks enough that the ECEs that differ between the two nodes are isolated and identified. A bi-directional skip-list can be used, for example, to determine and compare the hash values of ECD intervals.

Two nodes that communicate using the consistency protocol 216 may use the following RPCs:

1. SetEntries: SetEntries transmits new or updated ECEs to a node, which inserts them into the appropriate ECDs.
2. GetEntries: GetEntries transmits a key or a range of keys to a node, which returns the ECEs corresponding to those one or more keys.
3. SynEntries: SynEntries transmits a key or a range of keys to a node, and the two nodes then compare hashes of successively decreasing ranges of ECEs to determine which ECEs differ between the two nodes, as described above. If the ECEs differ, the nodes merge their ECEs so that the same ECEs are stored on the nodes by comparing the ITC timestamps; if the ITC timestamps match, the nodes compare the UTC timestamps associated with the ECEs. These timestamps act as version information that allows the two nodes to adopt the ECEs that have been most recently modified, as indicated by those ECEs' version information.

When a node changes ECEs, that node typically calls SynEntries to inform the other nodes in the site 108 that the ECEs have been changed. If some of the nodes in the site 108 are unavailable (e.g., they are offline), then the gossip protocol 208 instead of SynEntries is used to communicate top-level hashes to the unavailable nodes once they return online. As alluded to in the section discussing the gossip protocol 208 in the site 108 above, each of the nodes holds its top-level hash, which is spread to the other nodes along with a node identifier, version information, and heartbeat state using the gossip protocol 208. When another node receives this hash, it compares the received top-level hash with its own top-level hash. If the top-level hashes are identical, the ECEs on both nodes match; otherwise, the ECEs differ.

If the ECEs differ, regardless of whether this is determined using SynEntries or the gossip protocol 208, the node that runs SynEntries or that receives the top-level hash synchronizes the ECEs.

3. Status Protocol 218

As discussed above, the gossip protocol 208 shares throughout the site 108 status entity identifiers and their version numbers ("status entity pair") for nodes in the site 108. Exemplary status entity identifiers may, for example, represent different types of status data in the form of status entries such as how much storage the node has available; which devices (such as the non-node cameras 114) are connected to that node; which clients 102 are connected to that node; and site membership information. When one of the nodes receives this data via the gossip protocol 208, it compares the version number of the status entity pair to the version number of the corresponding status entry it is storing locally. If the version numbers differ, the status protocol 218 commences an RPC ("Sync RPC") with the node from which the status entity pair originates to update the corresponding status entry.

A status entry synchronized using the status protocol 218 is uniquely identified by both a path and a node identifier. Unlike the data synchronized using the consistency protocol 216, the node that the status entry describes is the only node that is allowed to modify the status entry or the status entity pair. Accordingly, and unlike the ECDs and ECEs synchronized using the consistency protocol 216, the version of the status entry for node A stored locally on node A is always the most recent version of that status entry.

If node A modifies multiple status entries simultaneously, the status protocol 218 synchronizes all of the modified status entries together to node B when node B calls the Sync RPC. Accordingly, the simultaneously changed entries may be dependent on each other because they will be sent together to node B for analysis. In contrast, each of the ECEs synchronized using the consistency protocol 216 is synchronized independently from the other ECEs, so ECEs cannot be dependent on each other as node B cannot rely on receiving entries in any particular order.

Applications

Each of the nodes in the system 100 runs services that implement the protocol suite 200 described above. While in the depicted embodiment one service is used for each of the protocols 202-218, in alternative embodiments (not depicted) greater or fewer services may be used to implement the protocol suite 200. Each of the nodes implements the protocol suite 200 itself; consequently, the system 100 is distributed and is less vulnerable to a failure of any single node, which is in contrast to conventional physical security systems that use a centralized server. For example, if one of the nodes (or sites, such as a child site or a parent site) fails in the system 100 ("failed node"), on each of the remaining nodes (or sites) the service running the status protocol 218 ("status service") will determine that the failed node is offline by monitoring the failed node's heartbeat state and will communicate this failure to the service running the node and membership protocols 210, 212 on each of the other nodes ("node service" and "membership service", respectively). The services on each node implementing the synchrony and consistency protocols 214, 216 ("synchrony service" and "consistency service", respectively) will subsequently cease sharing data with the failed node until the failed node returns online and rejoins its site 108.

The following describes the various applications 220-230 that the system 100 can implement. The applications 220-230 are various embodiments of the exemplary method for sharing data 800 depicted in FIG. 8. The method 800 begins at block 802 and proceeds to block 804 where a first node in the system 100 accesses a node identifier identifying another node in the system 100. Both the first and second nodes are members of the same server site 108. The node identifier that the first node accesses is part of the site membership information that identifies all the members of the site 108. The site membership information is accessible by all the members of the site 108. In the depicted embodiments each of the members of the site 108 stores its own version of the site membership information persistently and locally; however, in alternative embodiments (not depicted), the site membership information may be stored one or both of remotely from the nodes and in a central location. After accessing the node identifier for the second node, the first node sends the data to the second node at block 806, following which the method 800 ends at block 808. For example, when using the node service described above, the synchrony and consistency services running on the first node are able to send the data to the second node by using the second node's node identifier, and by delegating to the node service responsibility for associating the second node's communication endpoint to its node identifier. Sending the data from the first node to the second node at block 806 can comprise part of a bi-directional data exchange, such as when data is exchanged in accordance with the gossip protocol 208.

1. Shared Settings Application 226 and Shared User Objects Application 228

During the system 100's operation, persistently stored information is transferred between the nodes of a site 108. Examples of this real-time information that the shared settings and shared user objects applications 226, 228 share between nodes include shared settings, such as rules to implement in response to system events such as an alarm trigger, and user objects, such as user names, passwords, and themes. This type of data ("consistency data") is shared between nodes using the consistency protocol 216; generally, consistency data is data that does not have to be shared in real-time or in total ordering, and that is persistently stored by each of the nodes. However, in alternative embodiments (not depicted), consistency data may be non-persistently stored.

Figure 3:
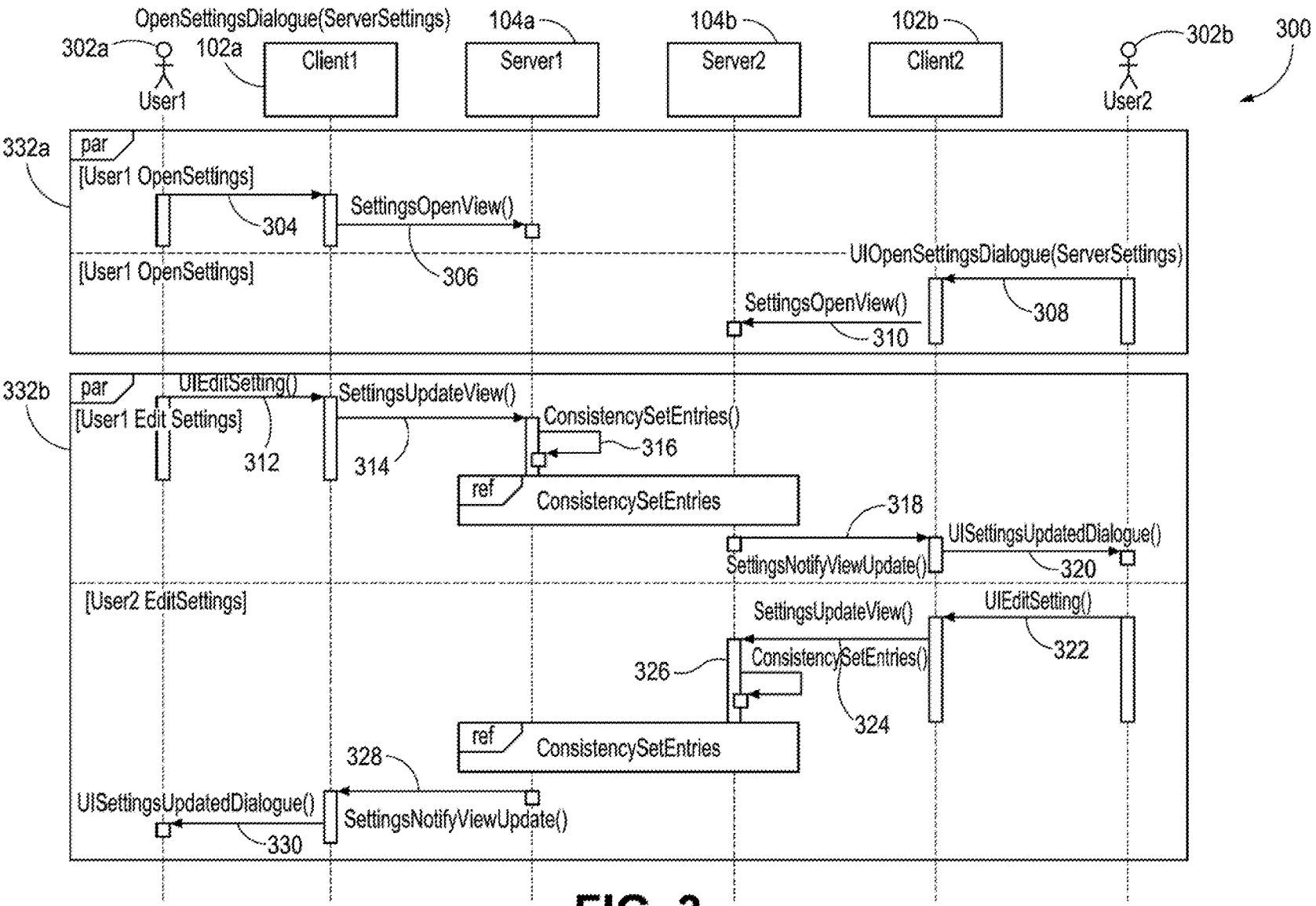
FIG. 3 is an exemplary Unified Modeling Language (UML) sequence diagram showing how the system of FIG. 1 shares settings between different system users.

FIG. 3 shows a UML sequence diagram 300 in which consistency data in the form of user settings are shared between first and second users 302*a, b* (collectively, "users 302"). The users 302, the first and second clients 102*a, b*, and the first and second servers 104*a, b*, which are the first and second nodes in this example, are objects in the diagram 300. The servers 104*a, b* form part of the same site 108*a*. As the servers 104*a, b* with which the clients 102*a, b* communicate are not directly connected to each other, the consistency protocol 216 is used to transfer data between the two servers 104*a, b*, and thus between the two users 302. Although the depicted embodiment describes sharing settings, in an alternative embodiment (not depicted) the users 302 may analogously share user objects.

The diagram 300 has two frames 332 *a, b*. In the first frame 332*a*, the first user 302*a* instructs the first client 102*a* to open a settings panel (message 304), and the client 102*a* subsequently performs the SettingsOpenView( ) procedure (message 306), which transfers the settings to the first server

104*a*. Simultaneously, the second user 302*b* instructs the second client 102*b* analogously (messages 308 and 310). In the second frame 332 *b*, the users 302 simultaneously edit their settings. The first user 302*a* edits his settings by having the first client 102*a* run UIEditSetting( ) (message 312), following which the first client 102*a* updates the settings stored on the first server 104*a* by having the first server 104*a* run SettingsUpdateView( ) (message 314). The first server 104*a* then runs ConsistencySetEntries( ) (message 316), which performs the SetEntries procedure and which transfers the settings entered by the first user 302*a* to the second server 104*b*. The second server 104*b* then sends the transferred settings to the second client 102*b* by calling SettingsNotifyViewUpdate( ) (message 318), following which the second client 102*b* updates the second user 302*b* (message 320). Simultaneously, the second user 302*b* analogously modifies settings and sends those settings to the first server 104*a* using the consistency protocol 216 (messages 322, 324, 326, 328, and 330). Each of the servers 104*a, b* persistently stores the user settings so that they do not have to be resynchronized between the servers 104*a, b* should either of the servers 104*a, b* reboot.

2. Shared Events and Alarms Application 224

During the system 100's operation, real-time information generated during runtime is transferred between the nodes of a site 108. Examples of this real-time information that the shared events and alarms application 224 shares between nodes are alarm state (i.e., whether an alarm has been triggered anywhere in the system 100); system events such as motion having been detected, whether a device (such as one of the node cameras 106) is sending digital data to the rest of the system 100, whether a device (such as a motion detector) is connected to the system 100, whether a device is currently recording, whether an alarm has occurred or has been acknowledged by the users 302, whether one of the users 302 is performing an audit on the system 100, whether one of the servers 104 has suffered an error, whether a device connected to the system has suffered an error, whether a point-of-sale text transaction has occurred; and server node to client notifications such as whether settings/data having changed, current recording state, whether a timeline is being updated, and database query results. In the present embodiment, the data transferred between nodes using the synchrony protocol 214 is referred to as "synchrony data", is generated at run-time, and is not persistently saved by the nodes.

Figure 4:
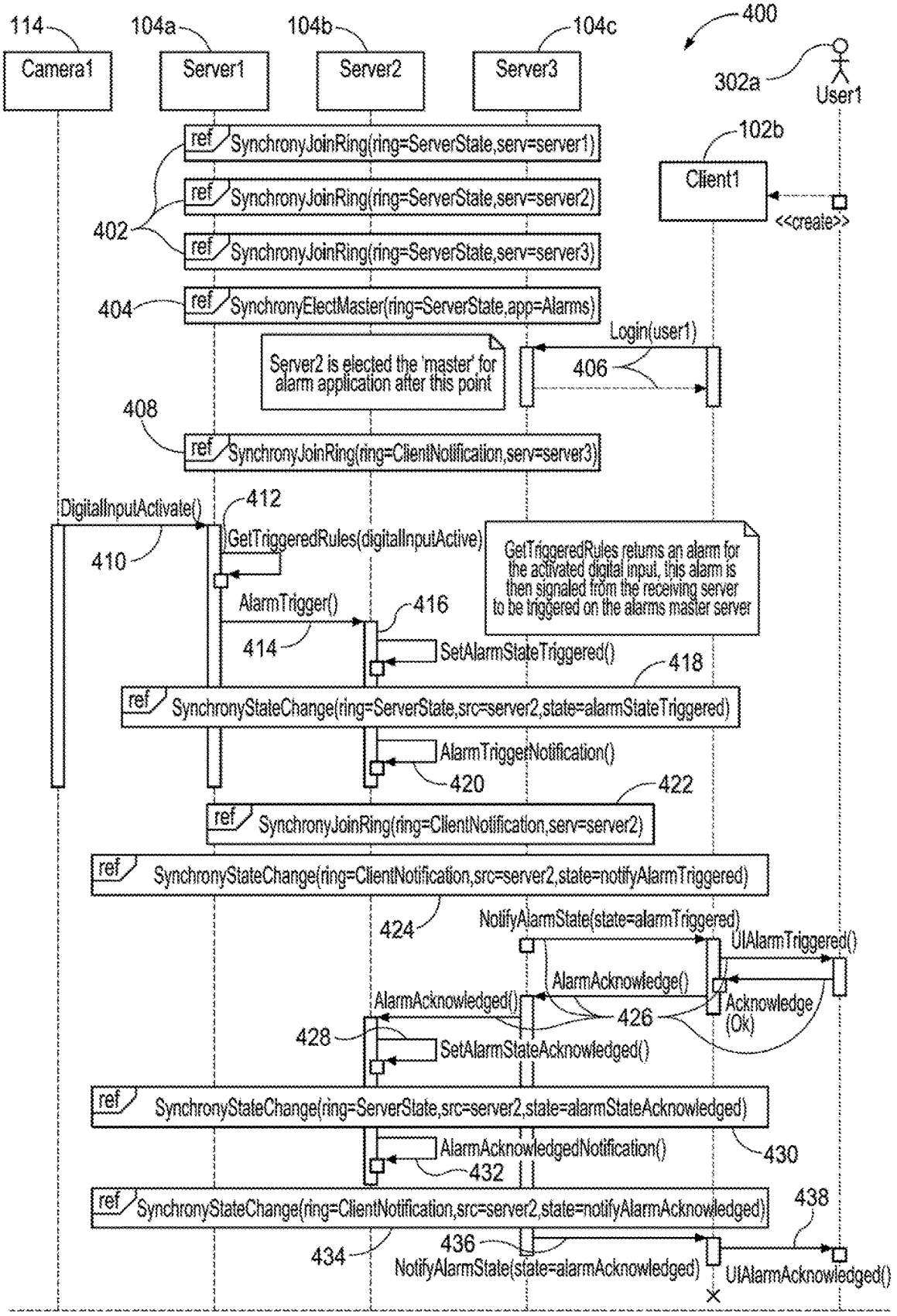
FIG. 4 is a UML sequence diagram showing how the system of FIG. 1 shares a state between different system users.

FIG. 4 shows a UML sequence diagram 400 in which an alarm notification is shared between the servers 104 using the synchrony protocol 214. The objects in the diagram 400 are one of the non-node cameras 114, the three servers 104 in the first site 108*a*, and the second client 102*b*, which is connected to one of the servers 104*c* in the first site 108*a*.

At the first three frames 402 of the diagram 400, each of the servers 104 joins a synchrony ring named "ServerState" so that the state of any one of the servers 104 can be communicated to any of the other servers 104; in the depicted embodiment, the state that will be communicated is "AlarmStateTriggered", which means that an alarm on one of the servers 108 has been triggered by virtue of an event that the non-node camera 114 has detected. At frame 404, the second server 104*b* is elected the "master" for the Alarms application; this means that it is the second server 104*b* that determines whether the input from the non-node camera 114 satisfies the criteria to transition to the AlarmStateTriggered state, and that sends to the other servers 104*a, c* in the synchrony ring a message to transition them to the AlarmStateTriggered state as well.

The user 302*a* logs into the third server 104*c* after the servers 104 join the ServerState synchrony ring (message 406). Subsequent to the user 302*a* logging in, the third server 104*c* joins another synchrony ring named "ClientNotification"; as discussed in further detail below, this ring is used to communicate system states to the user 302*a*, whereas the ServerState synchrony ring is used to communicate only between the servers 104. The non-node camera 114 sends a digital input, such as an indication that a door or window has been opened, to the first server 104*a* (message 410), following which the first server 104*a* checks to see whether this digital input satisfies a set of rules used to determine whether to trigger an alarm in the system 100 (message 412). In the depicted embodiment, the first server 104*a* determines that an alarm should be triggered, and accordingly calls AlarmTrigger( ) (message 414) which alerts the second server 104*b* to change states. The second server 104 then transitions states to AlarmStateTriggered (message 416) and sends a message to the ServerState synchrony ring that instructs the other two servers 104*a,c* to also change states to AlarmStateTriggered (frame 418). After instructing the other servers 104*a, c*, the second server 104*b* runs AlarmTriggerNotification( ) (message 420), which causes the second server 104*b* to also join the ClientNotification synchrony ring (frame 422) and pass a message to the ClientState synchrony ring that causes the third server 104*c*, which is the other server on the ClientState synchrony ring, to transition to a "NotifyAlarmTriggered" state (frame 424). Once the third server 104*c* changes to this state it directly informs the second client 102*b* that the alarm has been triggered, which relays this message to the user 302*a* and waits for the user 302*a* to acknowledge the alarm (messages 426). Once the user 302*a* acknowledges the alarm, the second server 104*b* accordingly changes states to "AlarmStateAcknowledged" (message 428), and then sends a message to the ServerState synchrony ring so that the other two servers 104*a, c* correspondingly change state as well (frame 430). The second server 104*b* subsequently changes state again to "NotifyAlarmAcknowledged" (message 432) and sends a message to the third server 104*c* via the ClientNotification synchrony ring to cause it to correspondingly change state (frame 434). The third server 104*c* then notifies the client 102*b* that the system 100 has acknowledged the alarm (message 436), which relays this message to the user 302*a* (message 438).

In an alternative embodiment (not depicted) in which the second server 104*b* fails and can no longer act as the master for the synchrony ring, the system 100 automatically elects another of the servers 104 to act as the master for the ring. The master of the synchrony ring is the only server 104 that is allowed to cause all of the other nodes on the ring to change state when the synchrony ring is used to share alarm notifications among nodes.

Figure 7:
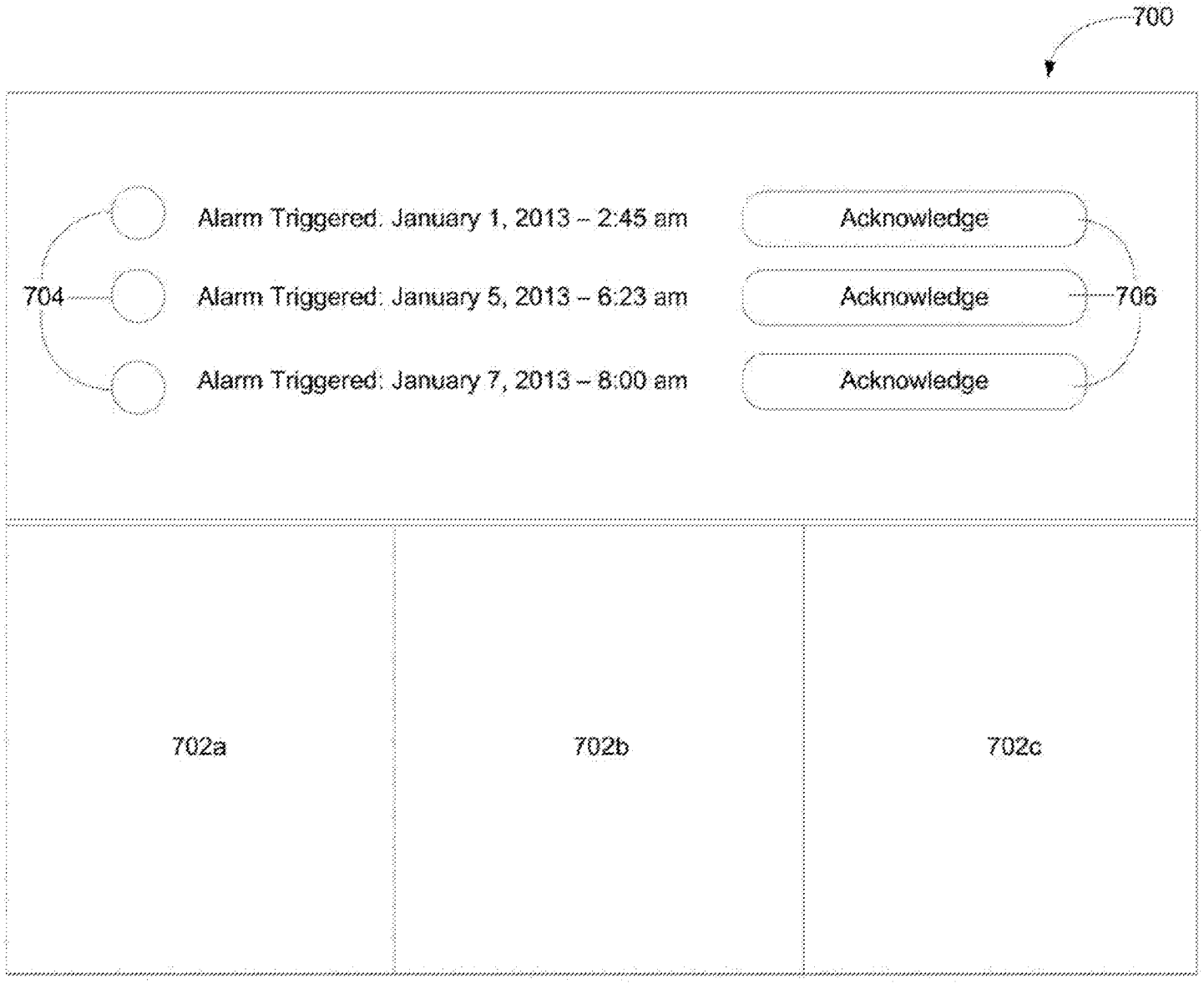
FIG. 7 is an example of a user interface provided by the system of FIG. 1.
Figure 8:
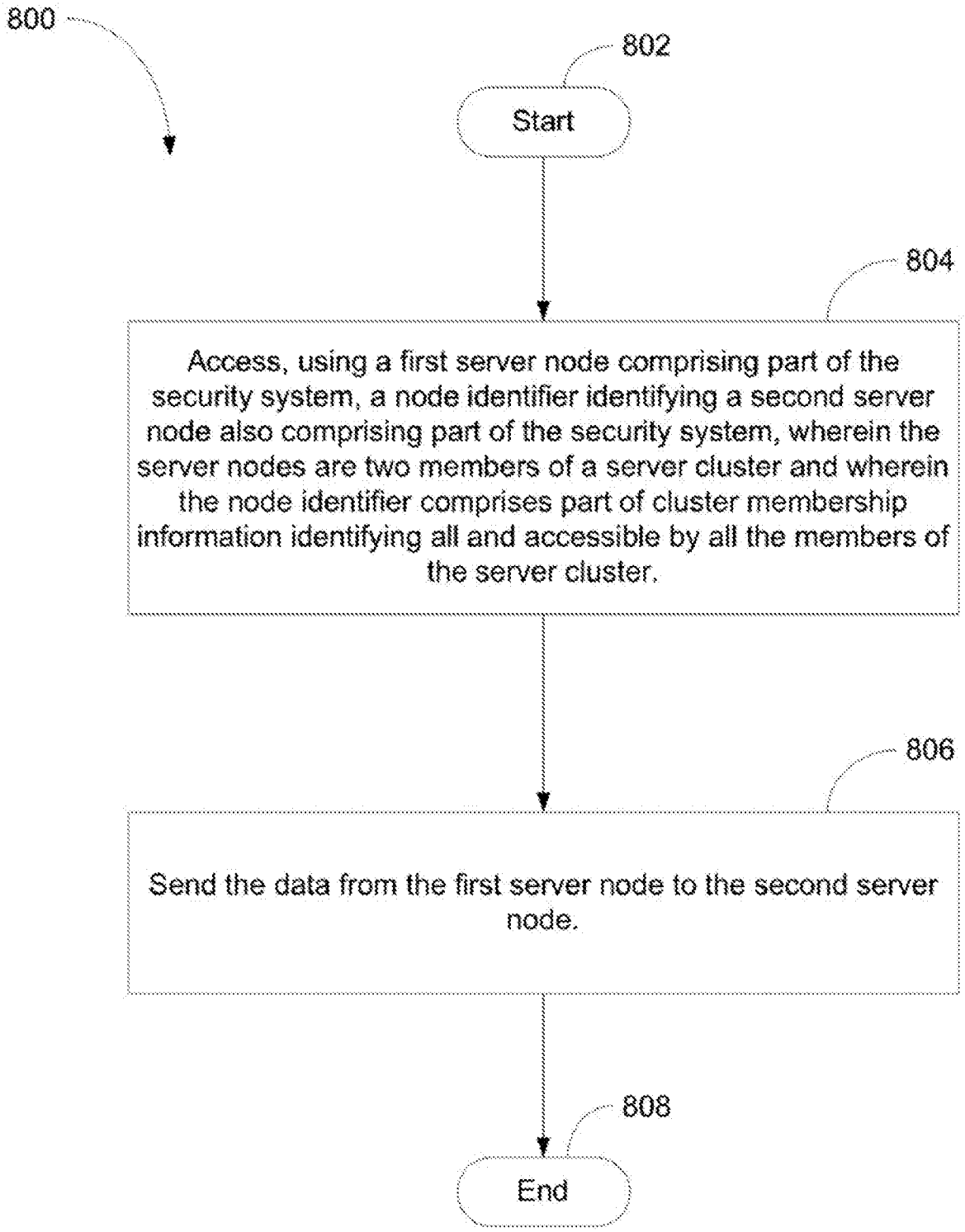
FIG. 8 illustrates a flow block diagram of a method for sharing data in a physical security system, according to another embodiment.
Figure 9:
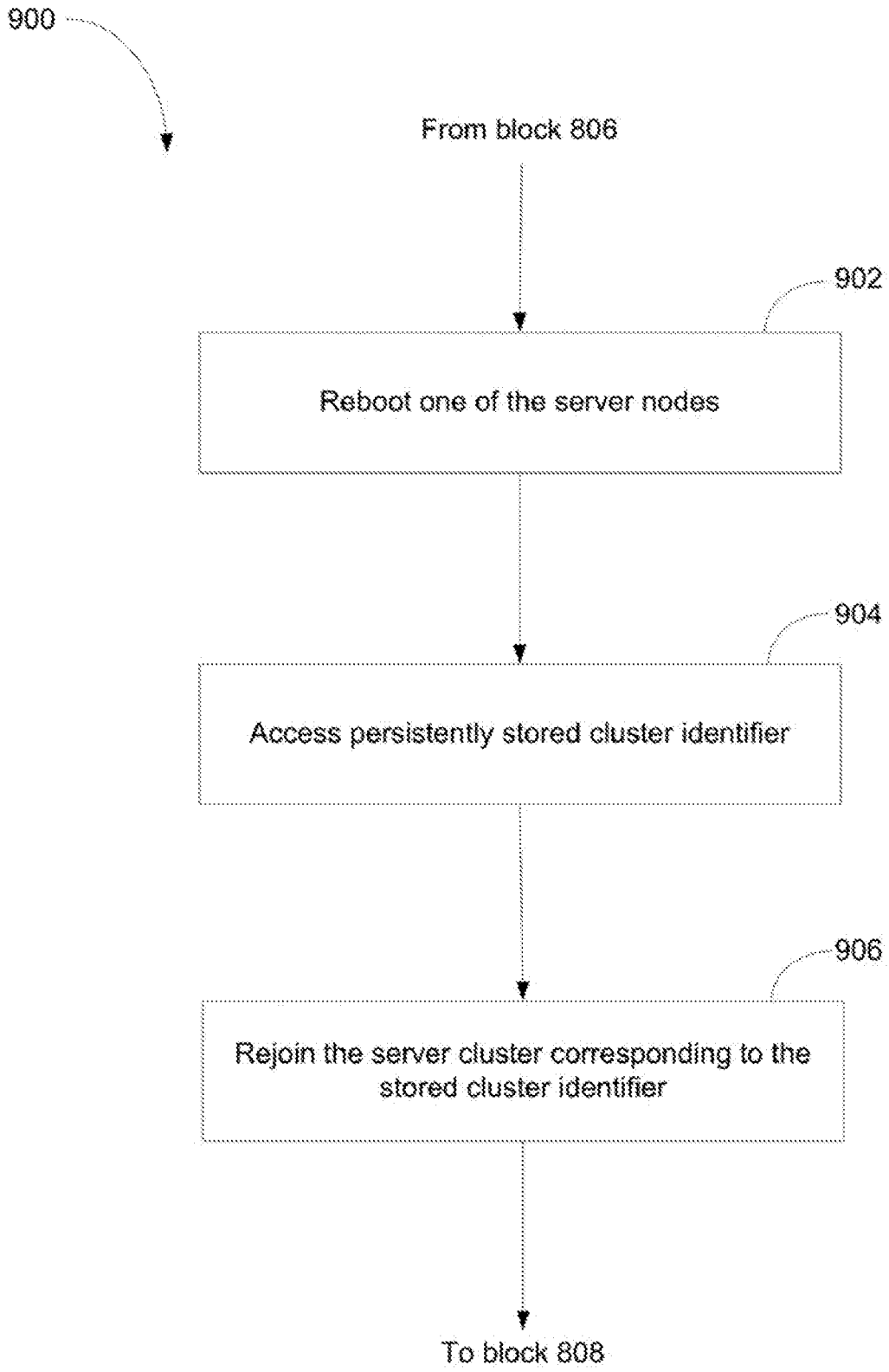
FIG. 9 illustrates a flow block diagram of a method for automatically rejoining a site, according to another embodiment.

FIG. 7 shows an exemplary view/user interface 700 presented to the users 302 when acknowledging an alarm state in accordance with the diagram 400 of FIG. 4. The view 700 includes video panels or areas 702 *a-c* (collectively "panels 702") showing real time streaming video from the non-node camera 114; alerts 704 indicating that an alarm has been triggered as a result of what the non-node camera 114 is recording; and an acknowledge button 706 that the user 302*a* clicks in order to acknowledge the alarm having been triggered.

3. Shared Views and Collaboration Application 222

The users 302 of the system 100 may also want to share each others' views 700 and collaborate, such as by sending each other messages and talking to each other over the system 100, while sharing views 700. This shared views and collaboration application 222 accordingly allows the users 302 to share data such as view state and server to client notifications such as user messages and share requests. This type of data is synchrony data that is shared in real-time.

Figure 5:
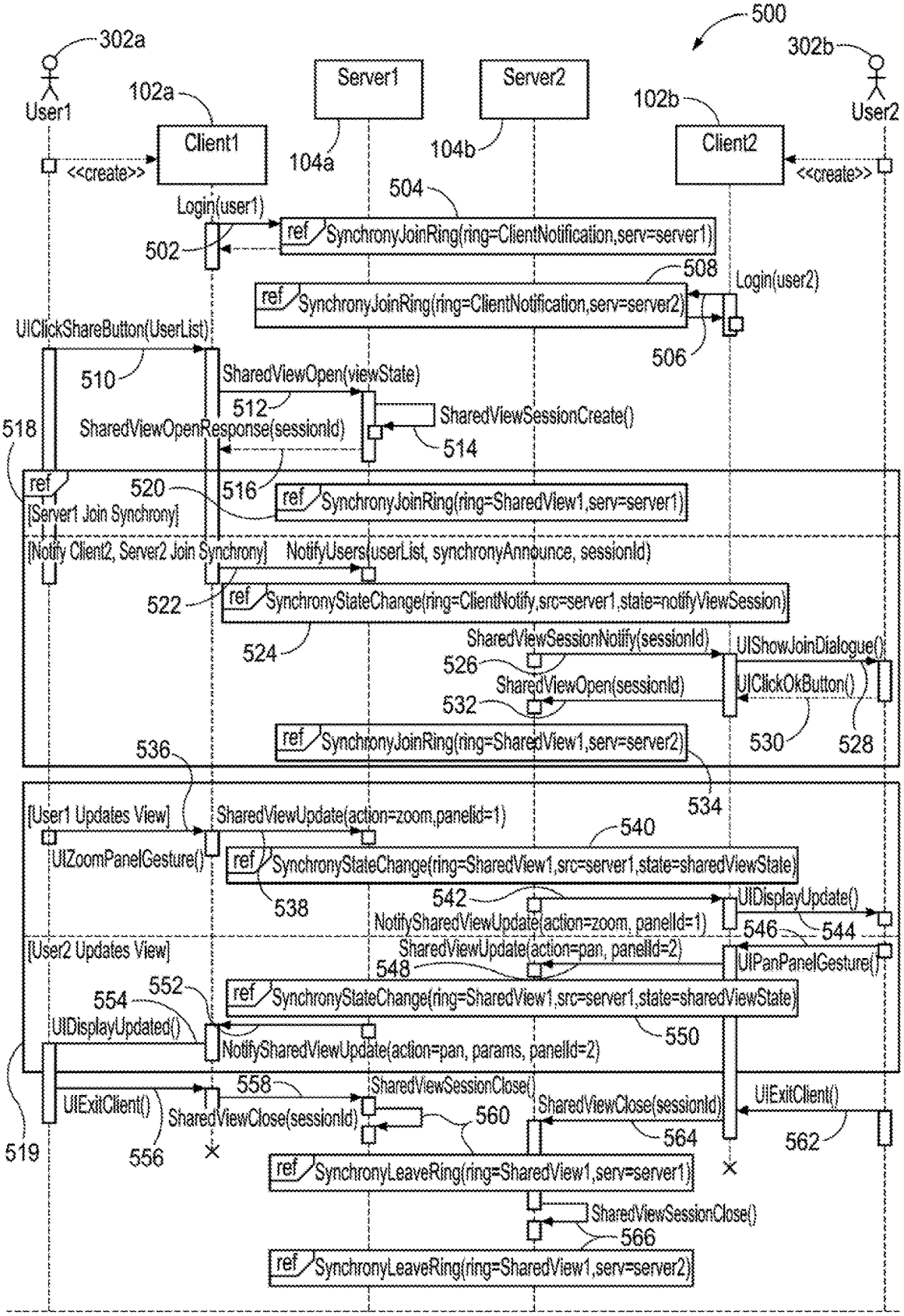
FIG. 5 is a UML sequence diagram showing how the system of FIG. 1 shares a view between different system users.

FIG. 5 shows a UML sequence diagram 500 in which views 700 are shared between the users 302 using the synchrony protocol 214. The diagram 500 includes six objects: the first and second users 302*a, b*, the first and second clients 102*a,b* to which the first and second users 302*a, b* are respectively connected, and the first and second servers 104*a, b* to which the first and second clients 102*a,b* are respectively connected.

The first user 302*a* logs into the first server 104*a* via the first client 102*a* (message 502), following which the first server 104*a* joins the ClientNotification Synchrony ring (frame 504). Similarly, the second user 302*b* logs into the second server 104*b* via the second client 102*b* (message 506), following which the second server 104*b* also joins the ClientNotification Synchrony ring (frame 508).

The first user 302*a* then instructs the first client 102*a* that he wishes to share his view 700. The first user 302*a* does this by clicking a share button (message 510), which causes the first client 102*a* to open the view 700 to be shared ("shared view 700") on the first server 104*a* (message 512). The first server 104*a* creates a shared view session (message 514), and then sends the session identifier to the first client 102*a* (message 516).

At a first frame 518, each of the clients 102 joins a synchrony ring that allows them to share the shared view 700. The first server 104*a* joins the SharedView1 synchrony ring at frame 520. Simultaneously, the first client 102*a* instructs the first server 104*a* to announce to the other server 104*b* via the synchrony protocol 214 that the first user 302*a*'s view 700 can be shared by passing to the first server 104*a* a user list and the session identifier (message 522). The first server 104*a* does this by sending a message to the second server 104*b* via the ClientNotify synchrony ring that causes the second server 104 to change to a NotifyViewSession state. In the NotifyViewSession state, the second server 104*b* causes the second client 102*b* to prompt the second user 302*b* to share the first user 302*a*'s view 700 (messages 526 and 528), and the second user 302*b*'s affirmative response is relayed back to the second server 104*b* (messages 530 and 532). The second server 104*b* subsequently joins the SharedView1 synchrony ring (message 534), which is used to share the first user 302*a*'s view 700.

At a second frame 519, the users 302 each update the shared view 700, and the updates are shared automatically with each other. The first user 302*a* zooms into a first panel 702*a* in the shared view 700 (message 536), and the first client 102*a* relays to the first server 104*a* how the first user 302*a* zoomed into the first panel 702*a* (message 538). The first server 104*a* shares the zooming particulars with the second server 104*b* by passing them along the SharedView1 synchrony ring (frame 540). The second server 104*b* accordingly updates the shared view 700 as displayed on the second client 102*b* (message 542), and the updated shared view 700 is then displayed to the second user 302*b* (message 544). Simultaneously, the second user 302*b* pans a second panel 702*b* in the shared view 700 (message 546), and the second client 102*b* relays to the second server 104*b* how the second user 302*b* panned this panel 702*b* (message 548). The second server 104*b* then shares the panning particulars with the first server 104*a* by passing them using the SharedView1 synchrony ring (frame 550). The first server 104*a* accordingly updates the shared view 700 as displayed on the first client 102*b* (message 552), and the updated shared view 700 is then displayed to the first user 302*a* (message 554).

After the second frame 519, the first user 302*a* closes his view 700 (message 556), which is relayed to the first server 104*a* (message 558). The first server 104*a* consequently leaves the SharedView1 synchrony ring (message and frame 560). The second user 302*b* similarly closes his view 700, which causes the second server 104*b* to leave the SharedView1 synchrony ring (messages 562 and 564, and message and frame 566).

In the example of FIG. 5, the users 302 pan and zoom the shared view 700. In alternative embodiments (not depicted) the users 302 may modify the shared view 700 in other ways. For example, the users 302 may each change the layout of the panels 702; choose whether video is to be displayed live or in playback mode, in which case the users 302 are also able to pause, play, or step through the video; and display user objects such as maps or web pages along with information about the user object such as revision history. In these alternative embodiments, examples of additional state information that is synchronized using a synchrony ring include whether a video is being played, paused, or stepped through and the revision history of the user object.

4. Site Streams Application 220

Figure 6:
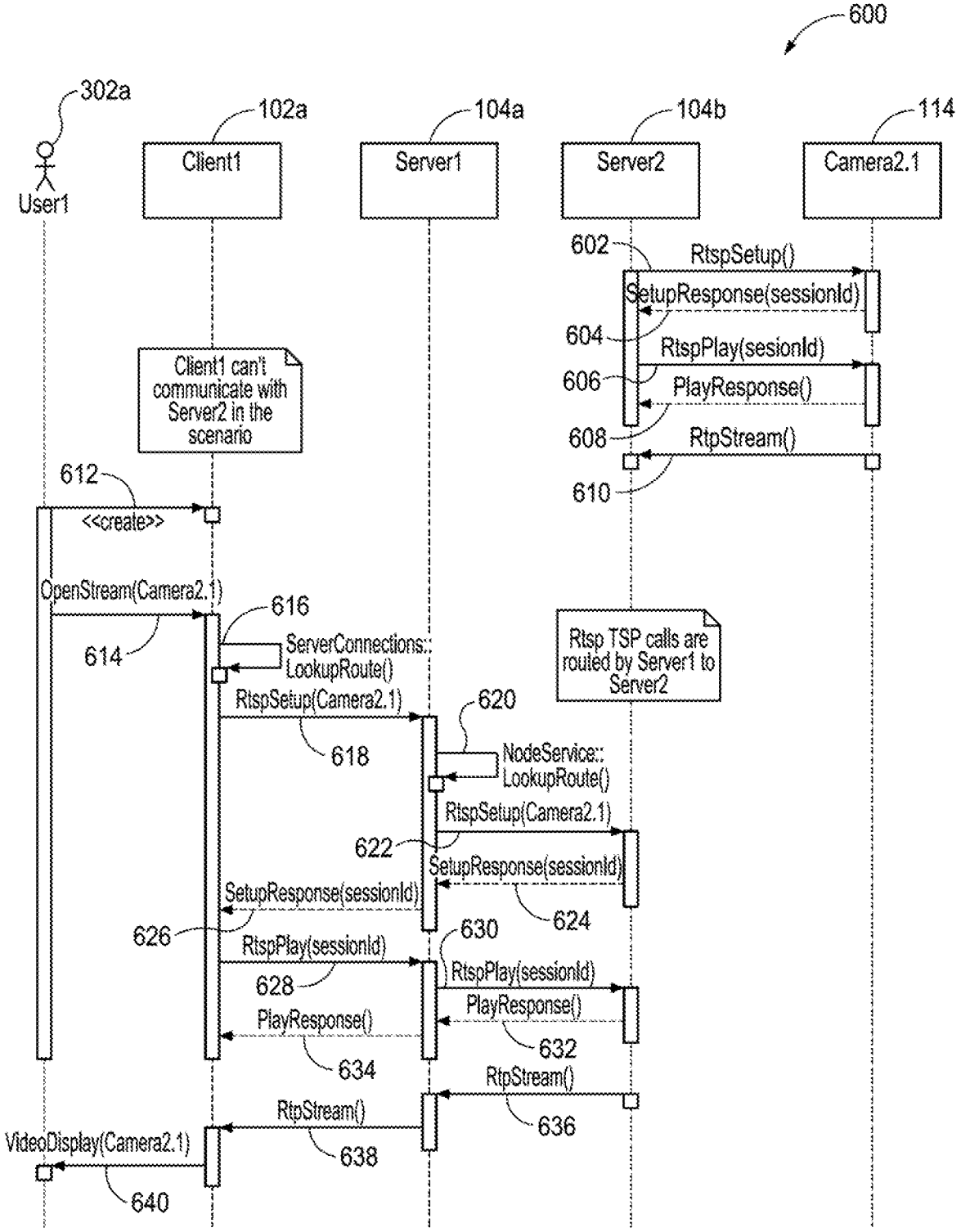
FIG. 6 is a UML sequence diagram showing how the system of FIG. 1 shares streams between different system users.

One of the users 302 may also want to stream video from one of the cameras 106, 114 if a point-to-point connection between that user 302 and that camera 106, 114 is unavailable; the site streams application 220 enables this functionality. FIG. 6 shows a UML sequence diagram 600 in which video is streamed from the non-node camera 114 to the first user 302*a* through the first and second servers 104*a, b* and the first client 102*a*. The UML diagram has five objects: the first user 302*a*, the first client 102*a*, the first and second servers 104*a, b*, and the non-node camera 114. The first client 102*a* can directly communicate with the first server 104*a*, but cannot directly communicate with the second server 104*b*. However, the first and second servers 104*a, b* can communicate directly with each other. Additionally, while the second server 104*b* and the non-node camera 114 can communicate directly with each other, the first server 104*a* and the non-node camera 114 cannot directly communicate.

The second server 104*b* first establishes a session with the non-node camera 114 so that video is streamed from the non-node camera 114 to the second server 104*b*. The second server 104*b* first sets up a Real Time Streaming Protocol (RTSP) session with the non-node camera 114 (messages 602 and 604), and instructs the non-node camera 114 to send it video (messages 606 and 608). The non-node camera 114 subsequently commences streaming (message 610).

The first user 302*a* establishes a connection with the first client 102*a* (message 612) and then instructs the first client 102*a* to open a window showing the streaming video (message 614). The first client 102*a* then calls LookupRoute( ) (message 616) to determine to which server 104 to connect; because the first client 102*a* cannot connect directly to the second server 104*b*, it sets up an RTSP connection with the first server 104*a* (message 618). The first server 104*b* then calls LookupRoute( ) to determine to which node to connect to access the real-time video, and determines that it should connect with the second server 104*b* (message 620). The first server 104*a* subsequently sets up an RTSP connection with the second server 104*b* (message 622), and the second server 104*b* returns a session identifier to the first server 104*a* (message 624). The first server 104*a* relays the session identifier to the first client 102*a* (message 626). Using this session identifier, the first client 102*a* instructs the second server 104*b* to begin playing RTSP video (messages 628 to 634), and the second server 104*b* subsequently streams video to the first user 302*a* via the second server 104*b*, then the first server 104*a*, and then the first client 102*a* (messages 636 to 640).

While FIG. 6 routes video from one of the non-node cameras 114 connected to one of the servers 104 in a site 108 to other servers 104 in the same site 108, in alternative embodiments (not depicted) video may also be routed from one of the node cameras 106 in a site 108 through the other node cameras 106 in the same site 108.

Rebooting

In the present embodiment, the site membership information is persistently stored locally on each of the nodes. When one of the nodes reboots, it automatically rejoins the site 108 of which it was a member prior to rebooting. This is depicted in the exemplary method 900 shown in FIG. 9. After performing block 806, one of the nodes in the site 108 reboots (block 902). Upon rebooting, this node accesses the persistently stored site membership information that identifies the site 108 of which it was a member prior to rebooting (block 904), and subsequently rejoins this site 108 (block 906) before returning to block 808. Having the nodes automatically rejoin a site 108 following rebooting is beneficial in that it helps the system 100 recover following restarting of any one or more of its servers. As each of the nodes persistently stores the consistency information, upon rejoining the site 108 only that consistency information that has changed since the node last left the site 108 is synchronized again, thereby saving bandwidth.

Although FIGS. 1-9 describe an exemplary operation of nodes and sites, the specific implementation of nodes and sites described in FIGS. 1-9 is not to be considered limiting.

Node Example

Figure 10:
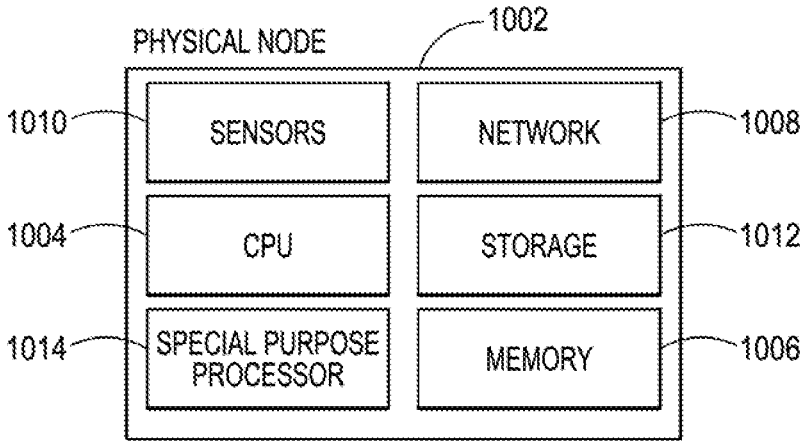
FIG. 10 is a diagram that illustrates an exemplary node in a security system.

FIG. 10 is a diagram that illustrates an exemplary node 1002. Node 1002 may be considered to be physical hardware running physical security software containing a CPU 1004, Memory 1006 and networking capabilities 1008. Node 1002 may also include sensors 1010 (such as Complementary Metal-Oxide-Semiconductor (CMOS) imaging sensors, Charge-Coupled Device (CCD) imaging sensors, thermal sensors, other cameras (such as cameras 114 of FIG. 1), and microphones, etc.), storage 1012, and special purpose processing units 1014 improve efficiency of CPU intensive tasks.

Video Management Software (VMS) Application Model

In a Video Management Software (VMS) application model, the node front-ends (the Application Programming Interface (API) and services that a server presents to client applications) present sites to VMS clients as a flat list of video sensor IDs without any hierarchy. Nodes and other sensor types are excluded from the default user view and only exposed in setup and configuration views. End users may organize the video sensors into logical hierarchies in the VMS that are independent of the physical structure and relationship of the nodes. Virtual sensors may also be created by configuring the association between audio sensors and video-sensors for example. The logical mappings between sensors may be stored in a directory that is synchronized between all nodes in a site. The physical hierarchy and physical nodes are exposed in VMS setup pages to allow users to configure nodes and entities that are not exposed in the logical view.

Figure 11A:
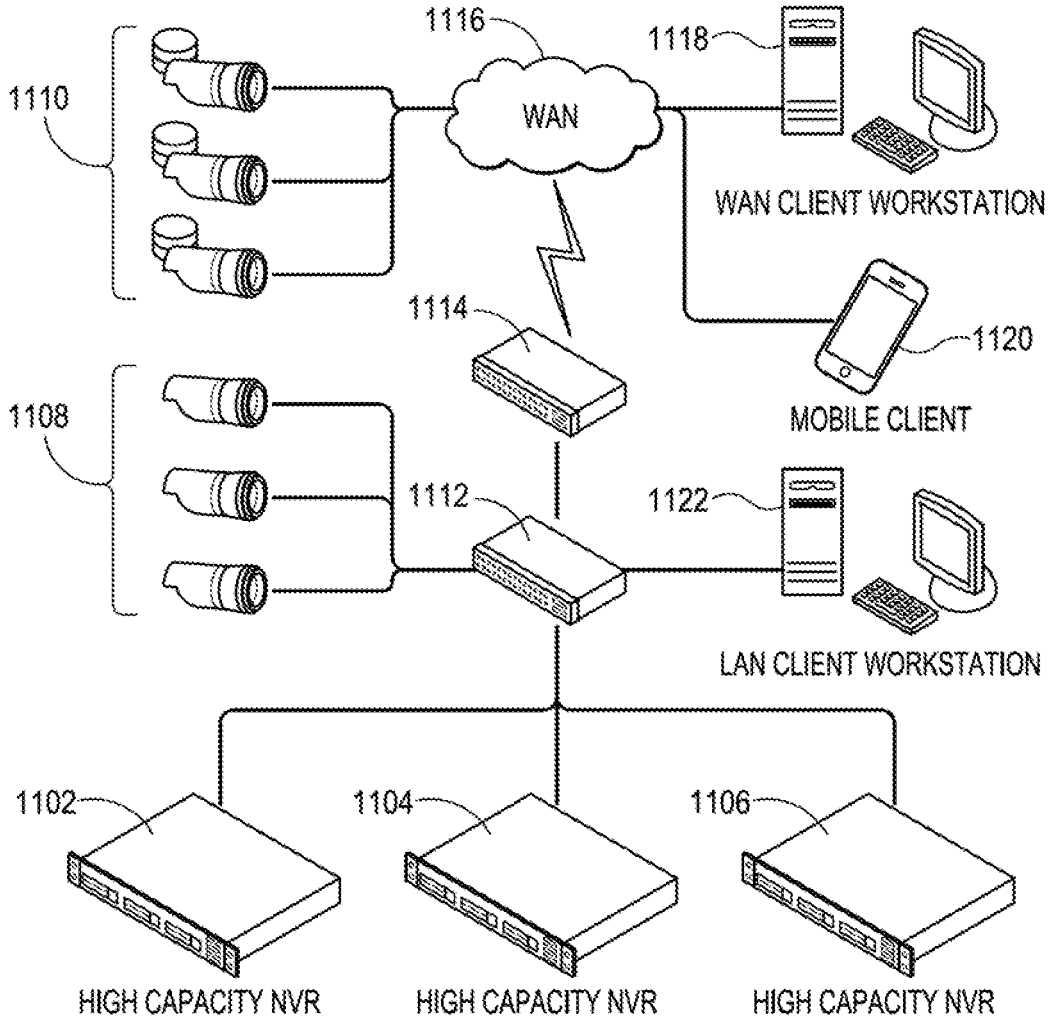
FIG. 11A is a diagram that illustrates a physical model representing a site for a Video Management System (VMS) application.

The presentation and logical organization of the site may be different depending on the application supported for the front-end. FIG. 11A is a diagram that illustrates a physical model representing site for a VMS application. The site consists of nodes that are high-capacity Network Video Recorder (NVR) systems 1102, 1104 and 1106 connected over a high-capacity, high-availability LAN and camera nodes with on-board storage 1110, and cameras nodes with program memory, but no video storage 1108 connected over reliable or unreliable links (for example, wireless, WAN 1116, or LAN). Also shown are WAN client workstation 1118, mobile client 1120, and LAN client workstation 1122, local switch 1112, and router 1114.

Exemplary System Architecture

Figure 11B:
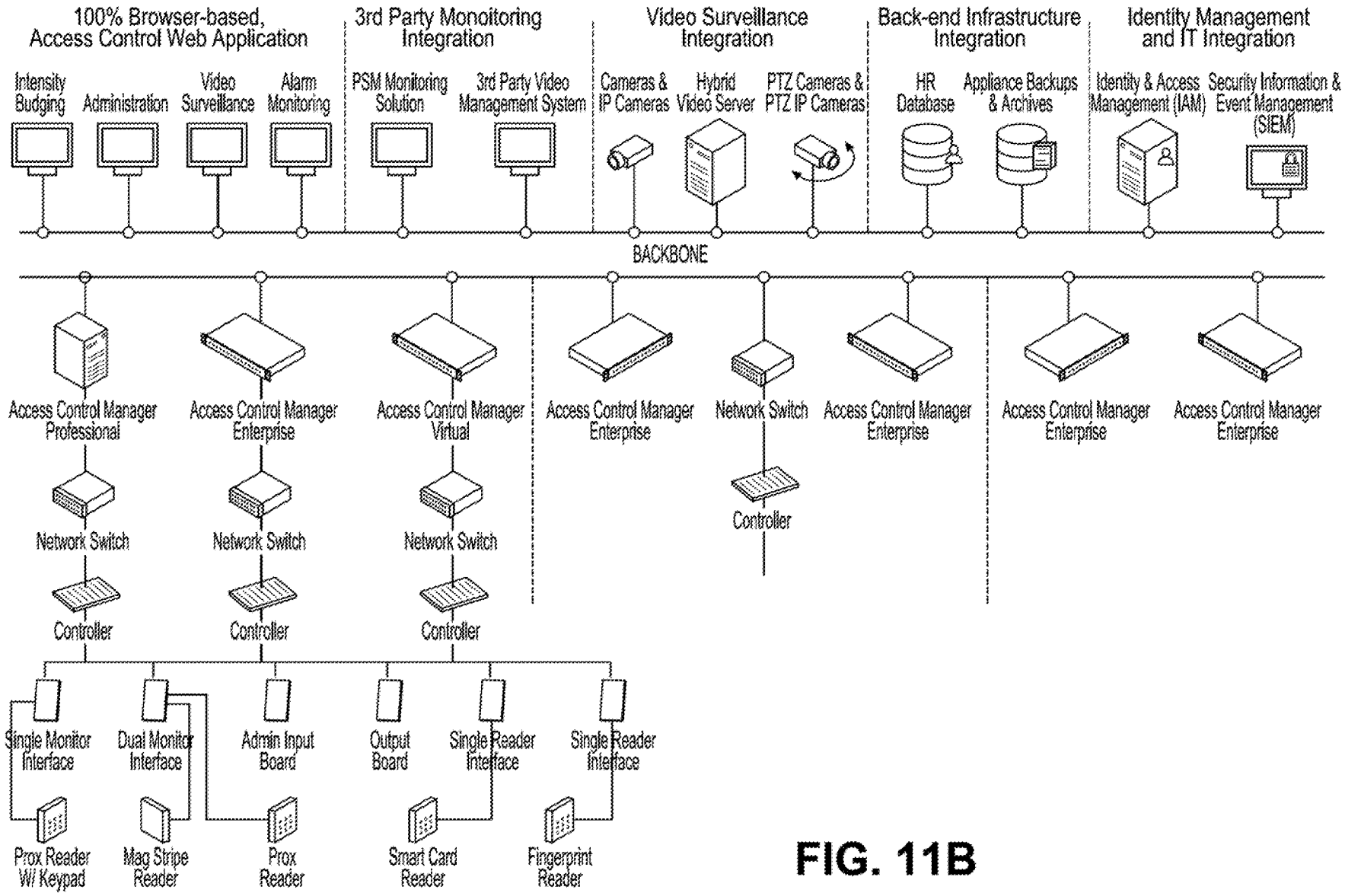
FIG. 11B is a diagram that illustrates an exemplary system architecture for a camera surveillance and access control system.

FIG. 11B is a diagram that illustrates an exemplary system architecture for a camera surveillance and access control system. The sites and nodes can be associated with cameras, access control devices, and other elements as shown in FIG. 11B. A distributed site management system described below can facilitate the management of surveillance systems, access control systems, and hybrid video and access control systems.

Site Families

Site families introduce a mechanism by which sites may be communicatively coupled to facilitate communication of organization-wide data such as users and groups settings. In addition, a hierarchy may be imposed on user-groups and sites within a site family to facilitate simplified setup of global access control and privileges. The hierarchy may also be used to limit the replication of sensitive data such as user login credentials to less trusted sites. If a hierarchy is defined for a site family, then individual sites may be placed within the hierarchy when they join the parent site. In one embodiment, a hierarchy exists prior to child site setup. Once the site family has been setup, groups may be managed from the parent site, and assigned a rank, which helps to determine the effective permissions of the users which are a part of that group and also determine which users and groups the parent will synchronize to a child site.

Sites in a site family are required to remain operational and highly available, even when site to site communication is over low-reliability and/or low capacity network links. At the same time, site families must support simple configuration of access control, user-management, data-synchronization policies, and network management from a central location. They may additionally support other global data synchronization to simplify system maintenance. For example, the synchronization of default system rules that are applied to all sites.

Embodiments may support a wide scale of systems from those consisting of only a few sites containing single server nodes to those consisting of thousands of sites containing many hundreds of nodes each and many thousands of users. A hierarchical model for configuration and access control simplifies the setup of these systems.

Figure 12:
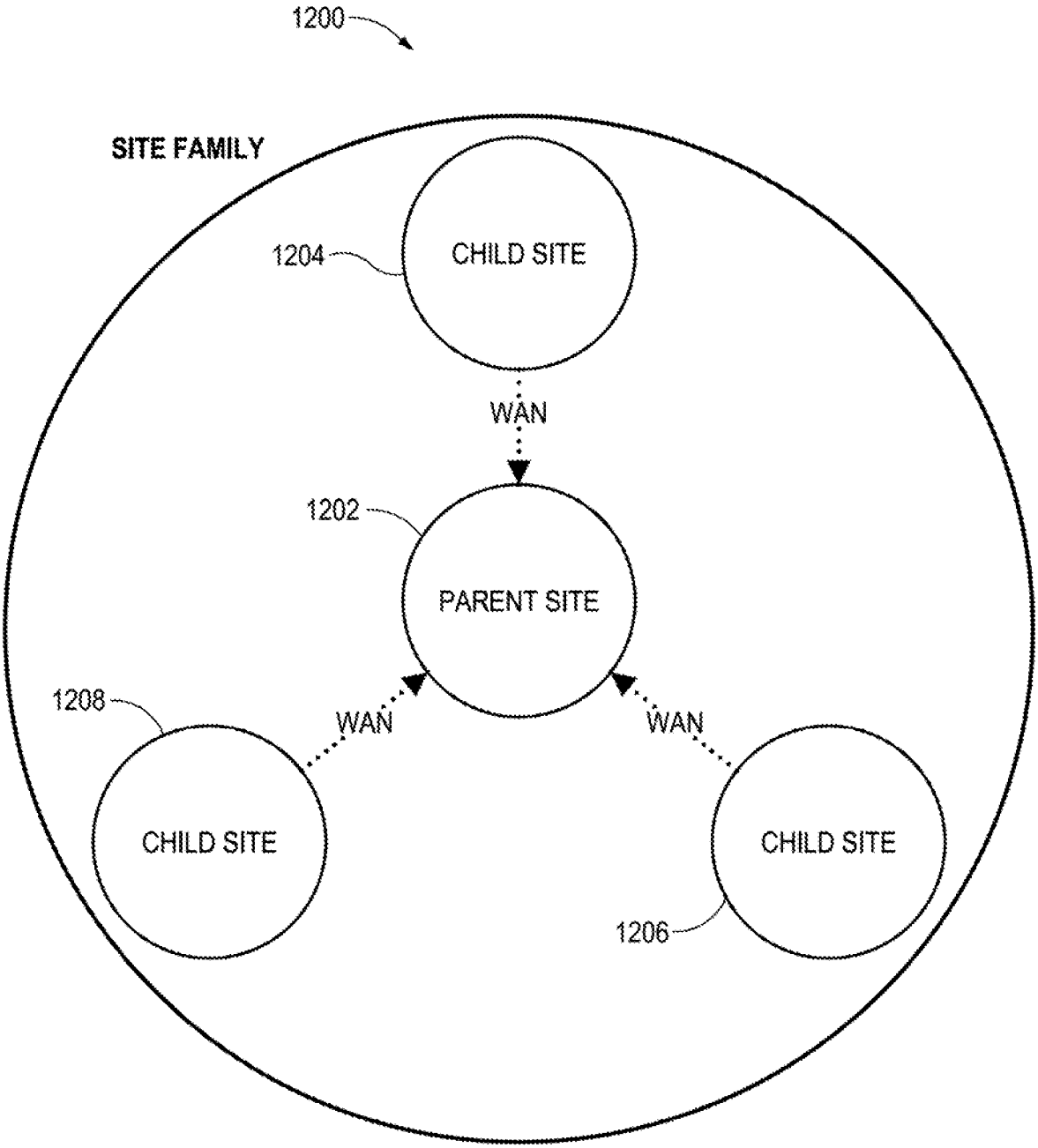
FIG. 12 is a diagram that illustrates a site-to-site communication hierarchy for a site family with three child sites connected to the parent site over a wide-area network.

FIG. 12 is a diagram that illustrates an example site hierarchy 1200 consisting of a parent site 1202 and several child sites 1204, 1206 and 1208 connected over a wide-area network. Child sites 1204, 1206 and 1208 communicate with a designated parent site 1202 for global configuration settings such as Access Control Lists (ACLs) for multi-site users. In one embodiment, a peer-to-peer model is not used in the site-family model because the child sites may not be located at physically secured locations and may not be trusted not to be compromised from a security standpoint. A single parent site 1202 allows that site 1202 to be physically secured against compromise and provides a location to store the most sensitive information such as the credentials of users with super-user access to all sites. ACLs may also be enforced by the parent site for all communication between the child site and parent site, preventing any child site from accessing restricted information, regardless of group, site, or user privilege levels.

Child sites 1204, 1206 and 1208 may be loosely connected and continue to operate independently in the absence of connectivity to the parent site 1202. Sites or site families may also be connected to cloud service platforms. Cloud services might include off-site archiving of critical sensor data, hosted metadata analysis, system reports, single-point client-access, or any other services that augment the platform capability.

Node, site, and multi-site models allow users to configure and manage systems at the appropriate scopes in an intuitive way. For example, policies or configuration may be defined at the site-level that only apply to a particular site or at the multi-site level if they apply to all sites.

Interfaces for Site Management on Child Site

Figure 13:
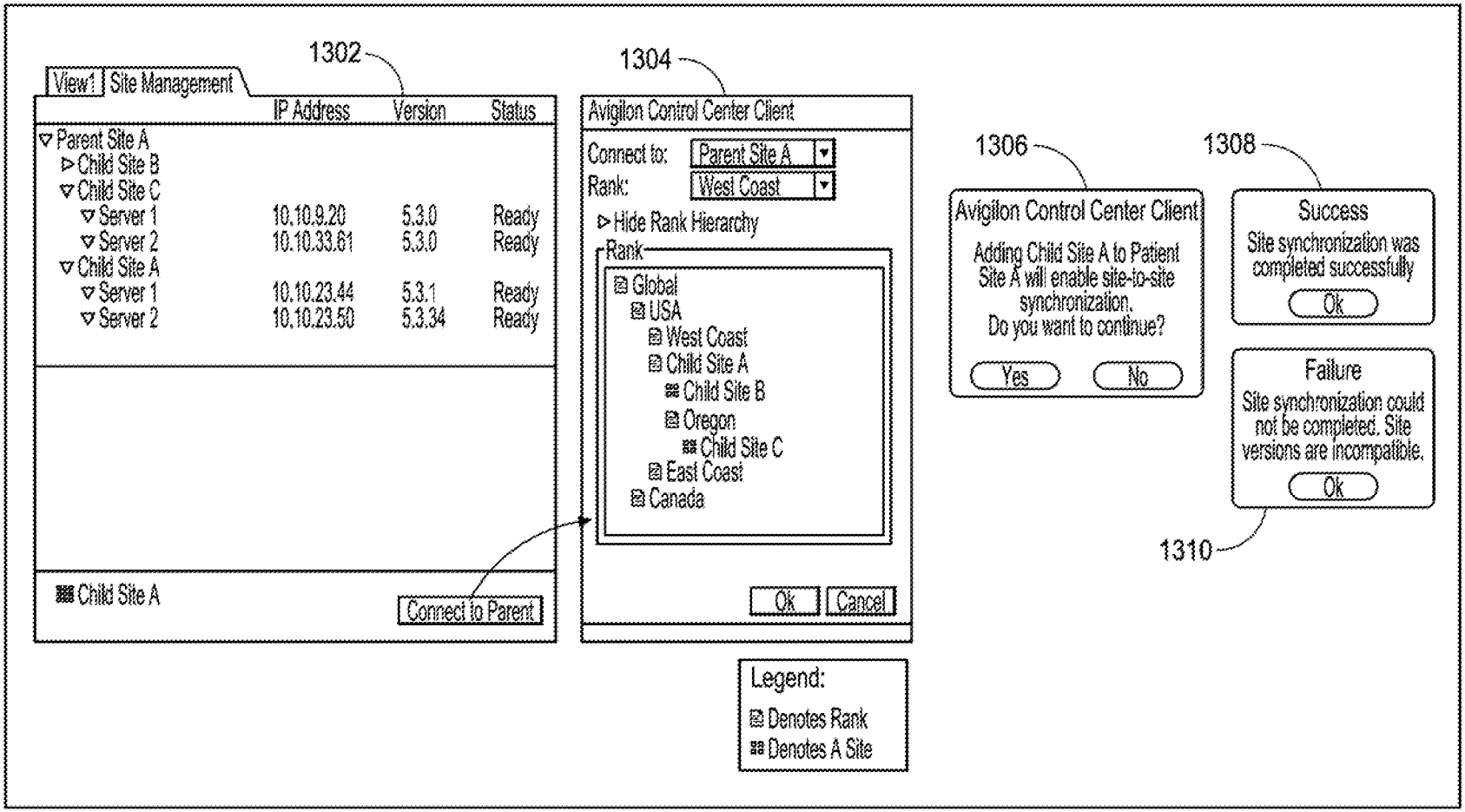
FIG. 13 is a diagram that illustrates a user interface for site management on a child site.

FIG. 13 is a diagram that illustrates interfaces (also referred to herein as a combined user interface) for site management on a child site. FIG. 13 shows an example of a user-interaction sequence for connecting a child site A to the parent site A and assigning it to the West Coast Rank. Interface 1302 corresponds to FIG. 1 and is the user interface (UI) representation of the 'physical' communication hierarchy, while interface 1304 corresponds to FIGS. 16 and 17 and is the UI representation of the 'logical' privilege hierarchy for the sites in a site family.

Interface 1302 allows for a child node to be selected. Interface 1304 allows the selected child node to be added into a hierarchy. Rank in the hierarchy is selectable, in this example, with a drop down list. Prompt 1306 indicates that adding a child site to a parent will allow site-to-site synchronization. Success of enabling the synchronization is shown with popup 1308 and failure with popup 1310.

In one embodiment, Child Site setup is located in a site management dialog. Sites with the capacity to be child sites may display a "synchronize" or "connect to parent" button and an indication of the status of site synchronization. Alternately, a user may drag or otherwise select and associate a child site into a parent site to add it to its hierarchy, which has the same effect. In one embodiment, a user needs to be logged in to both the parent and child and have appropriate permissions to add the child site to the hierarchy.

A drag and drop input, as an alternative to manually connecting and disconnecting, may also be used. In a drag and drop embodiment the user may drag and drop an icon of a child site to be associated with a parent site for example.

Connecting a site to a parent may be an explicit operation. The graphical user interface may have a specific button or selectable option to trigger the operation.

Connection of Child Site to Parent Site

Figure 14:
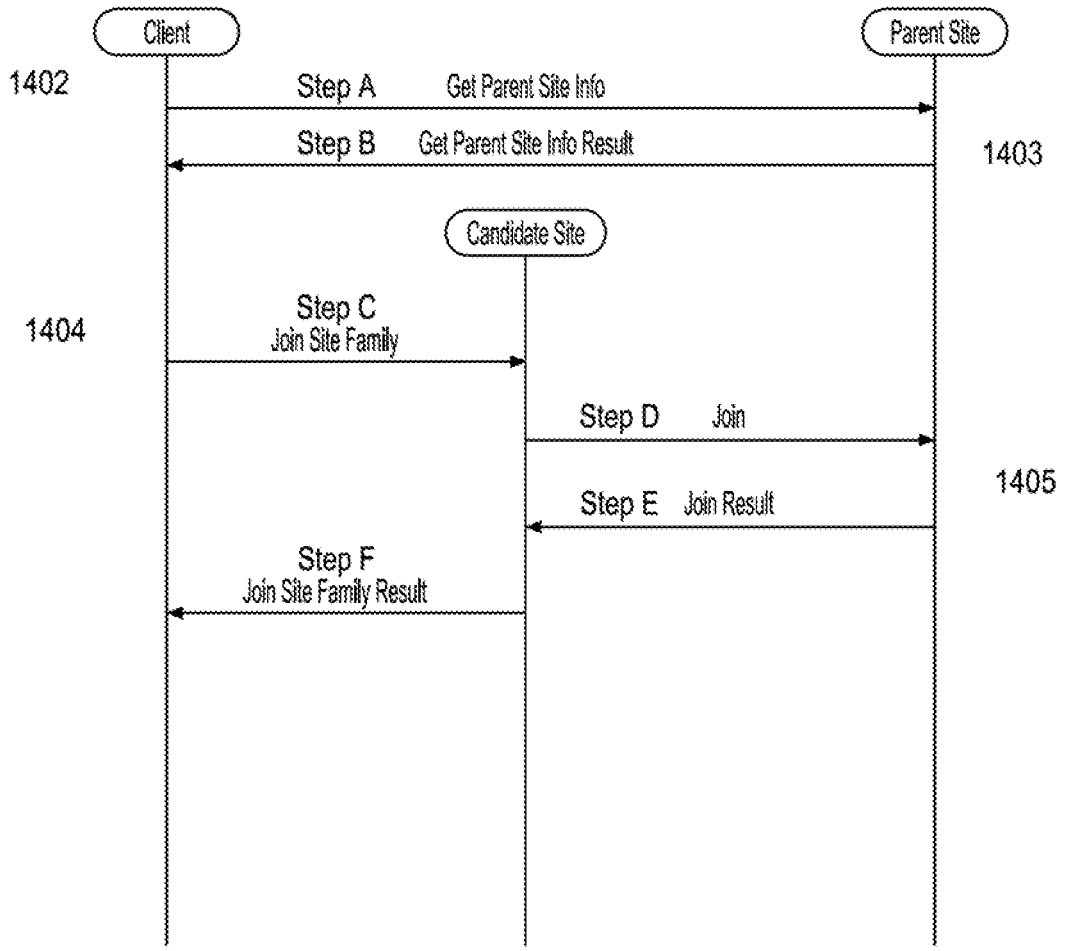
FIG. 14 is a message sequence chart that illustrates the flow for connecting to a site to a parent-site.

FIG. 14 is a message sequence diagram that illustrates how a candidate site may be connected to a parent (Site Family). The client has already established a secure login session 1402 to the parent site with at least 'manage site privileges' and a secure login session 1404 with all privileges to the candidate site.

In step A of FIG. 14, the client queries the parent site for information required by the candidate child site to join the site family.

In step B of FIG. 14, the parent site returns the result containing data 1403 about the Site Family. In embodiments that use token-based authentication, the parent site generates and returns a unique access token for use by the candidate site in this information. The client may bootstrap this data 1403 to the candidate site.

In step C of FIG. 14, the client issues a request to the candidate site to join the site family with the bootstrapped data 1403. In some cases, bootstrapped data 1403 may include an access token 1404, such as the unique access token generated by the parent site.

In step D of FIG. 14, the candidate site issues a join operation to the parent with the bootstrapped data 1403.

In step E of FIG. 14, the parent site generates an authorization data 1405 for the child site after authenticating the data 1403 contained in the Join. In embodiments that use token-based authentication, the parent site verifies the bootstrapped data, including the access token, and associates the token with the child site requesting the join. The parent site then stores the token and associated child site identity it in its persistent directory store.

In step F of FIG. 14, the parent returns the authorization data 1405 to the child site.

"Directory" and "Node" Services

A parent site containing multiple nodes may provide redundancy and allow the parent site to continue to provide services as long as any single node is running and reachable. In one embodiment, the authorization data 1405 for the child site are replicated by the "directory" services to all nodes in the parent site. In one embodiment, the server in the parent site handling the join request may save the authorization data using the shared user objects application 228 in which the child-site is treated as a special type of user. This ensures that the child site can be authorized to access resources from any node in the parent site. Furthermore, in one embodiment, the "node" services on the child site may be configured with all reachable endpoints of the parent site, for example, by providing a client interface for the user to add each endpoint manually. The "node" service maintains this endpoint list persistently in the child site. In the event that an endpoint for the parent site not reachable, the child site may attempt to connect using alternate endpoints stored in the node service. In another embodiment, the parent site may itself store a list of remotely accessible endpoints in the parent site directory. These endpoints may be configured through a user interface in a client connected to the parent site by a user with sufficient privileges. The user interface may be a simple list of endpoints to which the user can add or remove endpoints. In this embodiment, child sites connected to the parent site may be granted access to the parent site to synchronize these endpoints into their node service automatically without user configuration as in the previously described embodiment.

These remote endpoints may also be stored persistently in the child site directories. Remote clients given a single remote endpoint would download and cache the endpoints and use them to configure the client node service to provide connection redundancy to child sites. In some embodiments, child sites may also synchronize these remote endpoints with the parent site's remote endpoint directory. In these embodiments, a client application would, given a single accessible endpoint of the parent site, be able to download and configure its node service with the endpoints of all sites in the entire site family automatically, simplifying remote client configuration for very large site families.

The "node" services can be a node protocol that is responsible for generating a view of the system's network topology for each node, which provides each node with a network map permitting it to communicate with any other node in the system. In some embodiments, the network map is a routing table. The network map may reference communication endpoints, which are an address (IP/FQDN), port number, and protocol by which a node can be reached over the IP network that connects the nodes.

"Directory" services are application layer services that support the sharing of settings, credentials, system information, and other data between nodes. Shared settings application 226, and shared users objects application 228 are examples of directory services with persistent storage backing. System information 230 is an example of a directory service which may not have persistence in some embodiments as the information contained can be recovered at runtime. The underlying replication may be provided by various protocols in the data sync layer of FIG. 2, such as Synchrony 214, consistency 216, or status 218.

An administrator may see what users and groups are synchronized to a child site. This may require the child site to synchronize users and groups periodically with the parent.

In one embodiment, a server in a parent or child site may only be joined to a parent or child site if it is a singleton site. When joined, the server may synchronize settings with the site but will inherit non local settings such as remote users and groups and access credentials from the site it has just joined.

In one embodiment, a site cannot be configured to be a parent or child site if one or more servers in the site to do not support site family capabilities. In an embodiment, a parent site should reject a child site from joining a site family if one or more servers in that child site do not support site family capabilities.

In one embodiment, export of the global site family users and groups and hierarchy managed by the parent site are supported for backup purposes. A user interface may be provided in the client, which is available to appropriately privileged users connected to the parent site to export or import the users and groups to a file. In one embodiment, the exported setting cannot be imported to a child site since it is read-only on the child. In another embodiment, import may be supported through a child site which has appropriate write-access and privileges to the parent site. A child site should not export users and groups that it cannot authenticate. In one embodiment, a child site may not be able to export any remote users and groups since these groups may only be authenticated by the parent.

In one embodiment, a user may "connect" a site to a parent site. A user may "disconnect" a site from its parent. A user may centrally choose which users and groups to synchronize to each child to avoid "for each site" repetition. In one embodiment, non-repetitive assignment is enabled by the rank hierarchy and user-interfaces for managing users, groups and sites in this hierarchy.

Interface for Site Management of Parent Sites

Figure 15:
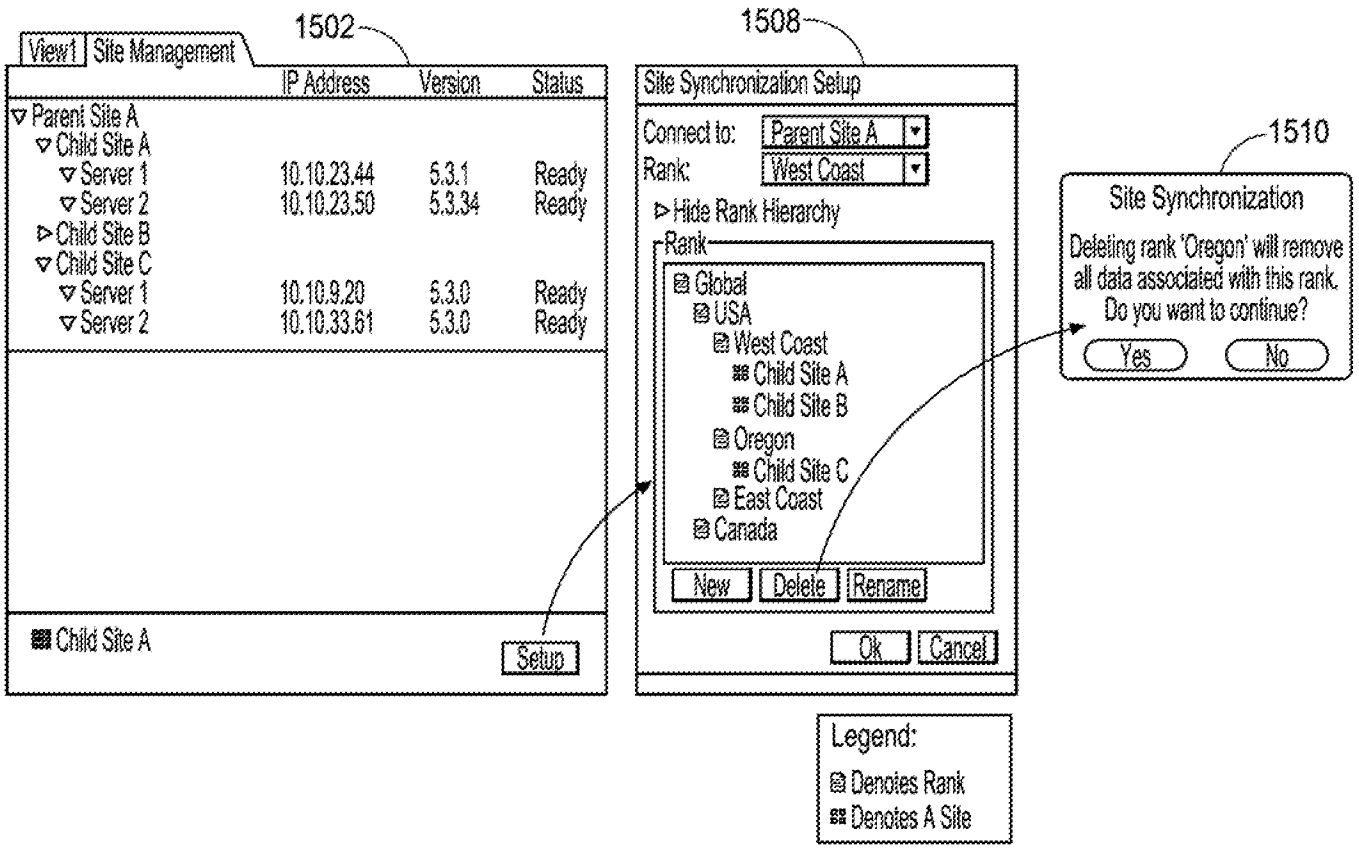
FIG. 15 is a diagram that illustrates a user interface for site management of parent sites.

FIG. 15 is a diagram that illustrates an interface for site management of parent sites. The example of FIG. 15 shows editing the rank hierarchy on the parent site by deleting the Oregon rank. Child Site C is orphaned and loses all privileges to the site family until it is assigned a new rank. (Rank hierarchy may allow drag-and-drop to re-arrange the rank of items).

Interface 1502 allows the selection of a parent site. Interface 1508 may be used to delete a rank with warning 1510 indicating the consequences of deleting a rank.

Child site synchronization setup may be located in a site management dialog. In some embodiments, child site synchronization may be enabled or disabled. For example, in FIG. 15, the interface 1502 may display a setup button when the parent site is selected which opens the interface 1508. Interface 1508 may contain a check-box to enable or disable synchronization with all child sites and indicate the current state of synchronization.

Rank

Figure 16:
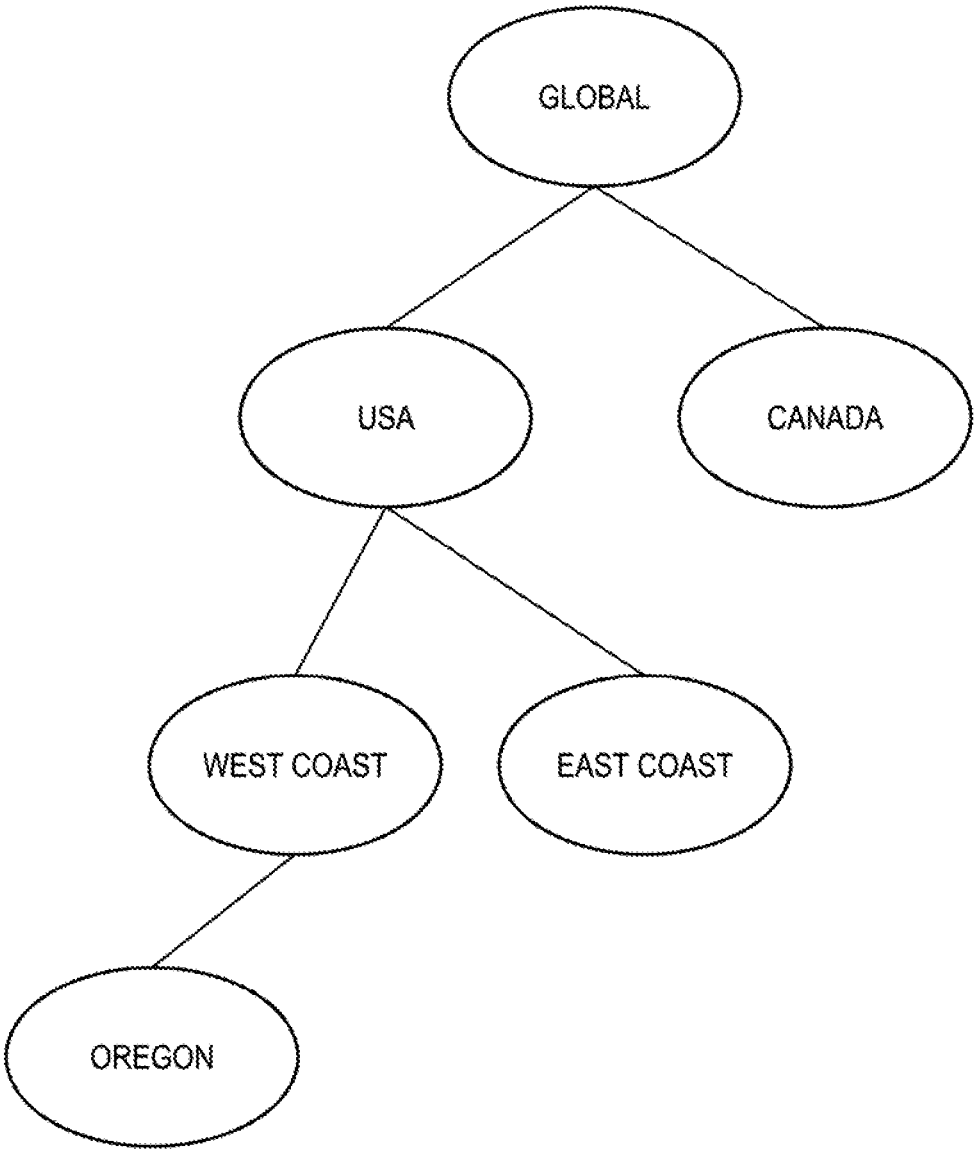
FIG. 16 is a diagram that illustrates rank represented as a tree structure.

FIG. 16 shows a tree which illustrates a set of hierarchical privilege levels (ranks) Objects assigned to a rank in this tree are granted privileged access to all ranks in the sub tree below the assigned rank, including the privilege to edit the sub tree. In the example of FIG. 16, the Global rank represents access privileges to the sub-tree containing Canada, and the sub tree containing USA and its children: East Coast, West Coast, and Oregon. The USA rank represents access to the East and West coast ranks. The rank names are generic and do not necessarily have to be geographical as illustrated in FIG. 16. For example, ranks may be organizational (e.g., Engineering, Operations, IT, etc.).

Figure 17:
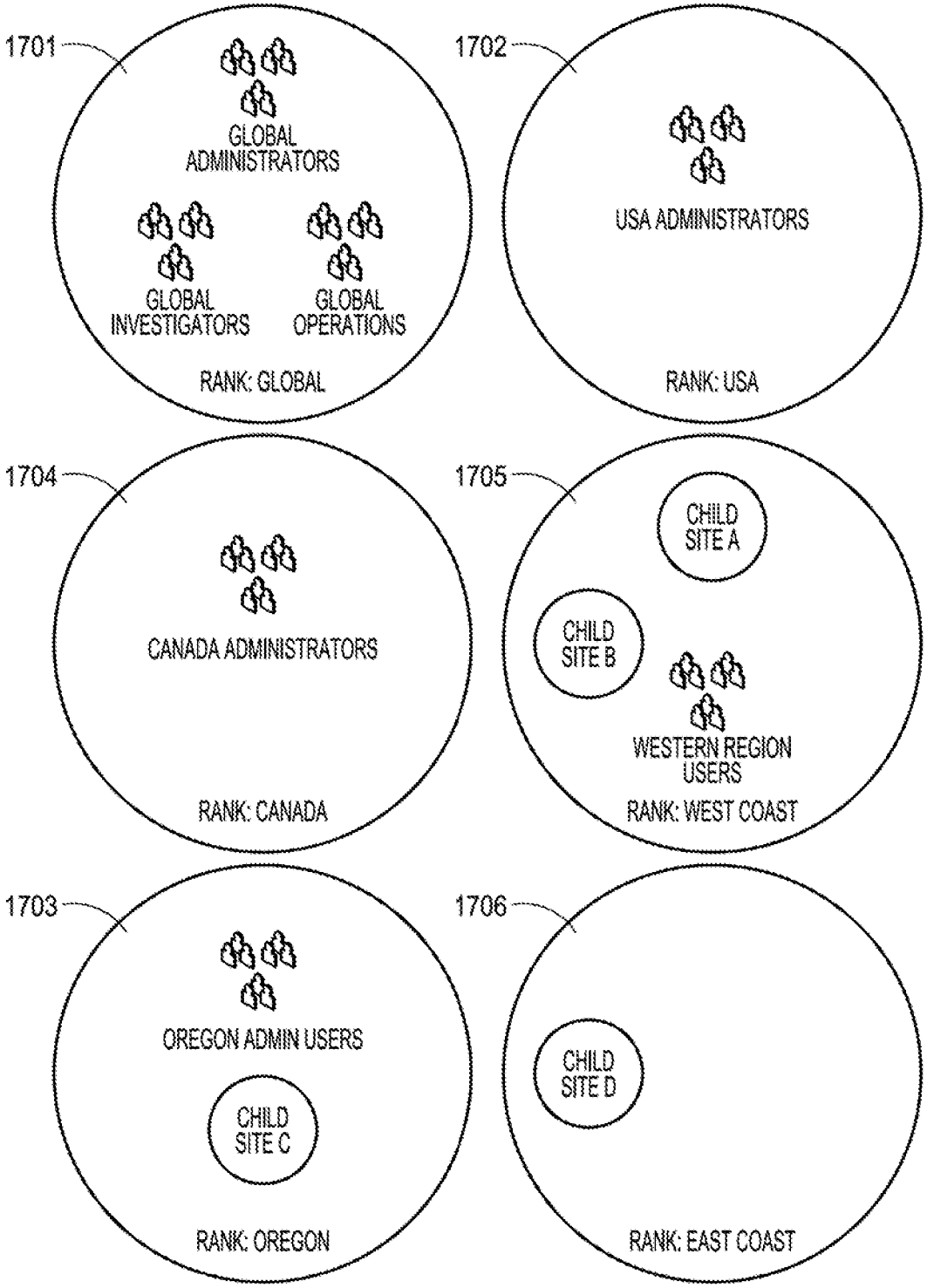
FIG. 17 is a diagram of objects that have been assigned a rank.

Objects can be assigned to a position in the rank tree from which they inherit a rank. FIG. 17, illustrates the relationship between objects and rank, and includes the ranks of Global 1701, USA 1702, Canada 1704, West Coast 1705, East Coast 1706, and Oregon 1703 with user-group and child site objects assigned to those ranks. The ranks in this example correspond to those with the same name in FIG. 16.

In one embodiment, a rank may be assigned to a group, such as global 1701, USA 1702, Canada 1704, West Coast 1705, East Coast 1706, and Oregon 1703 as shown in FIG. 17. A user that is a member of a ranked group inherits the group rank. A user that is a member of multiple ranked groups inherits a union of group ranks where the rank union is defined as the collection of sub trees of the group rank the user is a member of. For example, a user assigned to both Canada Administrators and the USA Administrators groups in FIG. 17 would have access to objects in both the Canada and USA sub trees of FIG. 16. In one embodiment, user rank determines which groups they are allowed to access. A ranked user may access or edit groups of lesser rank. In the example of FIG. 17, users which inherit the Oregon rank 1703 do not have privileges to modify any group, since there are no groups of lesser rank, while users belonging to the USA Administrators group, inherit USA rank 1702, and therefore, have privileges to access or modify the Western Regions Users, and Oregon Admin Users groups. Modifying a group may consist of assigning it to a higher rank, adding users to the group, or changing the privileges of the group, for example to allow or deny access to specified setup operations or live video in a VMS system.

In particular, in one embodiment, a user may not assign to a group a rank which is higher than their own rank. They may, however, assign to a group a rank which is equal to or less than their own rank. Similarly, a user may not assign privileges to other groups or sites which they themselves do not have.

In one embodiment, a rank may be assigned to a child site. The rank of the child site may determine which ranked users/groups have access to the site. In one embodiment, a ranked user may only access child sites of equal or lesser rank (the sub tree to which the user's group is assigned). In the example of FIG. 17, users with the Oregon rank 1703 can access child site C, but not child sites A, B or C; users with the West Coast rank 1705 can access child sites A, B and C, but not D; users with the USA 1702, or Global 1701 ranks can access child sites A, B, C and D. In one embodiment, the child sites to which a user does not have access are hidden from the user. The rank of a site may also control which sub-sets of global data may be accessed. For example, a site with Canada rank 1704 may not have access to groups or other objects assigned to USA rank 1702.

As a rank describes a set of sites, a user at that rank or higher has access to that set of child sites. A user can be presented with the rank hierarchy, and by selecting a rank, be automatically connected to all sites within that rank, facilitating a highly privileged user investigating an issue across multiple sites.

Configuration may be provided from the parent sites to child sites. This configuration may include rules, alerts, users, groups, device set up information, such as IP addresses for cameras, etc. This organizational structure may reduce the time required to manually set up the configuration at the child site. For example, the rule: 'send notification to local administrator users when any camera goes offline' may be defined as a global default rule for the entire site family. Child sites would synchronize this rule from the parent site whenever it was changed or edited by users. The ranks may also be used to determine the scope of alarms, notifications and other events. For example, West coast administrators may be given warnings when a West Coast server goes down, but not notified if an East Coast server goes down.

In one embodiment, the "Global" rank in the hierarchical tree is immutable. Global represents the root node in the hierarchy with the implication that there may be no rank "greater" rank than Global.

Some groups may not have assigned ranks Unranked Groups are not part of the privilege hierarchy tree. They may include, by default, the following groups on a newly-created site: Administrators, Power Users, Standard Users, and Restricted Users.

In one embodiment, unranked groups are not synchronized between sites and exist only as locally defined groups with access rights and privileges that apply to the site that owns and manages them. A user assigned to an unranked group has access limited to the site which manages the group. If an unranked group has privilege to modify the rank hierarchy, and the site managing the unranked group also has the privilege to modify the rank hierarchy, users belonging to the group may edit or assign unranked groups to the rank hierarchy. Once a group is assigned to the rank hierarchy, it may be synchronized between sites. In one embodiment, none of the child sites have the privilege to modify the rank hierarchy or assign ranks to groups, so only the parent site is capable of modifying the rank hierarchy or assigning groups to it.

In one embodiment, only users who are members of Unranked groups, and who have the manage users and groups privilege may create other Unranked groups. Unranked groups should not be confused with the groups of Global rank; the former are not a part of the hierarchy and may access any ranked object, including Global; the latter may only access objects with assigned rank.

In one embodiment, some sites may have local users that are not synchronized with other sites, but assigned to a group with rank which is synchronized between sites. In this case, the user inherits the privileges and access rights from the group, but is not synchronized between sites. The user access is therefore limited to the local site.

All other ranks may be user-defined, via an interface accessible through a setup panel by a user with the sufficient privileges such as the manage hierarchy privileges.

Rank not only applies to groups, but also to sites in a site family. A child site's rank may determine what other synchronizable ranked objects (such as users and groups) will be synchronized to that site. The synchronization of users and group may imply which users have access to the child site. For example, see FIG. 18, in which child site A does not have access to objects above the West Coast rank.

A site may be either parent site or child site or neither. A child site in a site family is an object which may have its access to data available from the parent site restricted to minimize the scope of sensitive data exposure if that child site is compromised. For example, the child site may be limited to only accessing user authentication functionality from the parent such as global groups and ranks and users, but not the passwords of those users. A child site without password access would rely on the parent site for user-authentication. In some embodiments, the access level of the child site to the parent is the intersection of the user-privileges and the site-privileges. For example, a super-user with privileged access to global admin users and their credentials logged into a child site that does not have privileged to access global admin users, would not be able to access the global admin users. The super user would be required to log into the parent site to access this user-data.

In some embodiments, the child site may cache the ranks, groups, and user credentials downloaded from the parent site to allow these users to log-in when the parent site is unavailable. Different caching policies may be defined to limit potential compromise of the user credentials. Some examples of policies are to allow caching of lower privileged users, but not high-privilege users (for example users that have the privilege to modify other user privileges, or manage sites in the site family); or to limit the time credentials are cached by erasing the credentials after a fixed period of time. Alternately, authentication may be delegated to the parent site if passwords are not cached on the child site. In this case, users and group objects on the child sites may be read-only. Not caching passwords on the child site may have security advantages.

The parent and child sites may mutually authenticate each other in a way that both sites are assured of each other's identities to prevent site impersonation and man-in-the-middle attacks. In some embodiments, this may be achieved by exchanging a shared secret when the child site is connected to the parent that can be used to later establish a secure communication channel via a protocol such as Transport Layer Security Secure Remote Password (TLS-SRP). Alternately, certificates may be exchanged when a child site is joined to the site family and both the child site and parent site may use certificate pinning combined with traditional Transport Layer Security (TLS) and mutual authentication to establish secure communication channels between the child and parent.

Synchronization

In one embodiment, sites may optionally synchronize external users and groups from a directory based synchronization system, such as Active Directory (AD) produced by Microsoft to be managed within the site family. Groups synchronized from AD into a site may be unranked, or assigned to a default rank. The access control policies for AD users and groups are the same as for non-AD users and groups. A ranked AD user may access lower ranked users and access child sites of equal or lesser rank. AD users and groups imported by the parent may be assigned ranks and synchronized to child sites. For Site Families where the parent site manages AD synchronization, the child sites are not required to be on the same AD domain or synchronize with AD if AD user login authentication to the child sites is delegated through the parent. Active Directory (AD) users may 'inherit' the rank of the AD groups they are members of A child site can also create local users by synchronizing users and groups from the Active Directory (AD). A child site is not required to be on the same AD domain as the parent site nor is the parent site required to be on an AD domain. Access rights for objects local to sites do not need to be synchronized and may remain local to a site. Site-site synchronization may use a Master-Slave synchronization model. No peer-peer synchronization need be used. Synchronization may be pull-based (on-demand by events such as login or edit settings on the child site) rather than push-based (on notification from the parent-site). In one embodiment, a site-site synchronization mechanism may be used to propagate users, groups, and root privileges from parent to child sites.

Child sites may optionally periodically synchronize information about their status and configuration (from the node and status protocols) to a parent site within the site family to allow for centralized monitoring for system issues, such as server failures. In one example, if a parent site has previously received status and health information from a child site, it may infer from a sudden lack of the periodic synchronization that a child site has failed entirely, and indicate the failure or disconnectivity, for example, via a user interface. This allows users with small child sites of only a single node to detect the failure of those nodes.

In one embodiment, a status report from a child site to a parent may be a summary (e.g. "healthy" or "not healthy"). In the absence of a status report from a child site, status of a child site may be unknown, and a parent site may infer that the child site has failed (e.g. failure or disconnected), and present this status to a user via a user interface.

In one embodiment, the parent site maintains the "master" user and group directory. In that case, the child sites treat the master database as read-only. Changes to users, group and privileges may be applied on the parent site after which they synchronized to a child site from the parent.

In one embodiment, a user may edit user, group, and root privileges on a child site, where the master copy is managed by the parent site. In that case, the child site may both read and write to the master group directory on the parent site to synchronize changes. Changes of remotely synchronized objects on the child may be cached locally and synchronized with the parent later.

The child site may be authenticated in order to be authorized to synchronize data from the parent. The parent site may use token based authentication and authorization scheme to verify child site credentials. In some embodiments, this access token is associated with and ACL and rank on the parent site and persistently stored in that parent site directory. The child site retains its own copy of the access token in its own directory. The access token may be uniquely generated for each authorized child site.

Interfaces to Manage Groups and Access Rights

Figure 18:
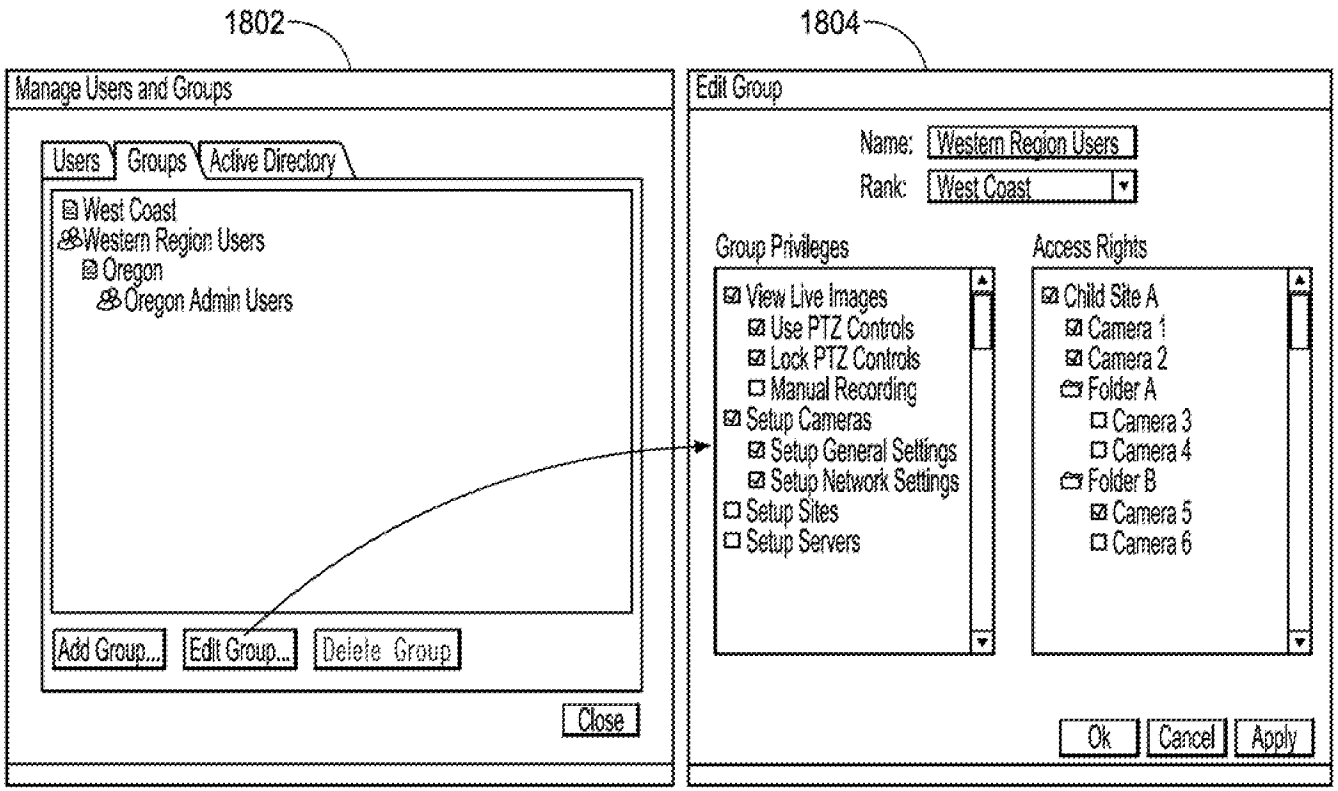
FIG. 18 is a diagram that illustrates a user interface to add or edit a group of child nodes.
Figure 19:
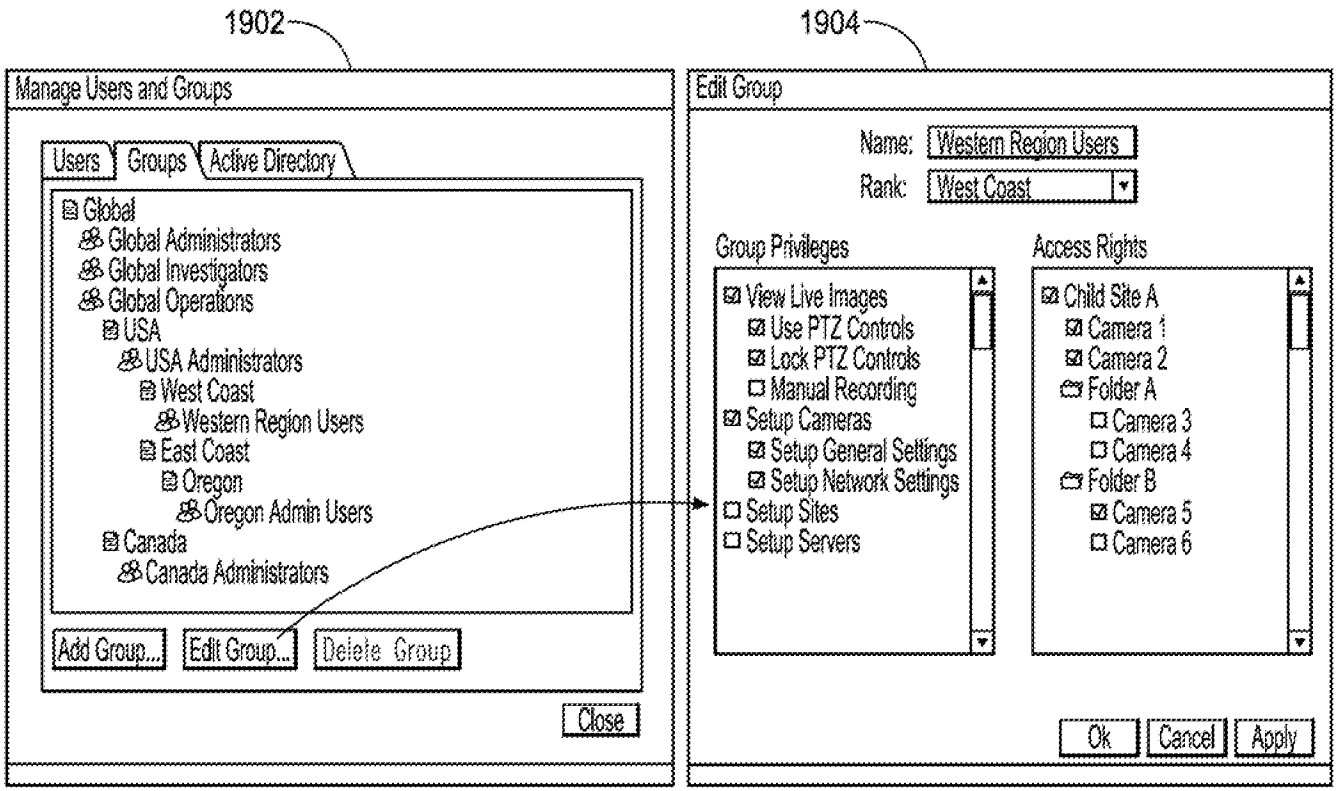
FIG. 19 is a diagram that illustrates a user interface for setting up users and groups on the parent.

FIGS. 18 and 19 show user interfaces to manage groups and access rights.

Interfaces 1802, 1902 allows for the selection of a group. Groups may be shown in a tree structure or displayed in a flat structure with the rank column. In some embodiments, the list of groups shown for editing may be restricted based on the access rights. Interfaces 1804, 1904 allows for editing name, rank, privileges, and local site access rights for the group. In some embodiments, portions of the interfaces may be hidden or read-only depending on the access rights of the site from which the groups are being edited and the privileges of the user performing the edits.

FIG. 18 shows editing of the non-local Western Region Users group from Child Site A of the West Coast Rank in an example embodiment where the Western Region Users group is owned and managed by the parent site and child-sites are limited read-only access to non-local groups below their assigned rank. In interface 1802, a limited view of the rank hierarchy of FIG. 16 is available as Child Site A does not have privilege to access other objects outside of the west-coast sub-tree. In interface 1804, the group name, rank, and privileges are read-only because in the example embodiment, Child Site A does not have the rights to edit those properties as they are managed by the Parent Site. Interface 1804 does allow the editing of the local access rights in the example embodiment as these objects are locally owned and managed by Child Site A and the logged-in user has sufficient privileges to edit them.

FIG. 19 is a diagram that illustrates editing the Western Region Users group from Parent Site A in an example embodiment where the parent site owns and manages the Western Regions group. Interface 1902 shows all group objects of FIG. 17 in the rank hierarchy of FIG. 16 as the Parent Site has global rank. In interface 1904, the name, rank, group privileges and local access rights for Western Region Users are editable as the parent site and editing user have sufficient access rights to modify the properties of these objects.

A graphical user interface may be provided to allow a user to see the structure of the site family (rank hierarchy and what groups and sites belong to each rank). In one embodiment, this graphical user interface will help users understand the effect of any changes they make will have.

Remote Authentication

In one embodiment, in order for a child site to synchronize user and group objects from its parent, the child must be authenticated and authorized by the remote site. A child site may be authenticated by requiring the user to log into the child and parent sites in order to connect the parent site to the child. This ensures that only privilege users may authorize the connection of child sites to parents.

Server-to-server synchronization between the servers in the child site and servers in the parent site may be lightweight. Servers need not be required to maintain the state and resources associated persistent connections and a pushed-based notification channel since a "REST" API may be used to synchronize data across sites using polling. In one embodiment, child sites may pull data as required, and/or at periodic intervals as opposed to receiving push-based updates from the parent over a notification channel. For example, a child site may synchronize groups, users and authentication data necessary to confirm user identity, privileges and credentials only when that user logs into the child site (on-demand). In such an embodiment, the child site may use a persistent access token acquired from the parent site to which the parent site associates an Access Control List (ACL) associated with the rank. The ACL prevents the child site from accessing resources from the parent, even if the user ACL has higher effective privilege.

In another example, users and groups and site hierarchies may only be synchronized when a user accesses the site and group setup interfaces in the client-UI to make sure they are up to date.

Figure 20:
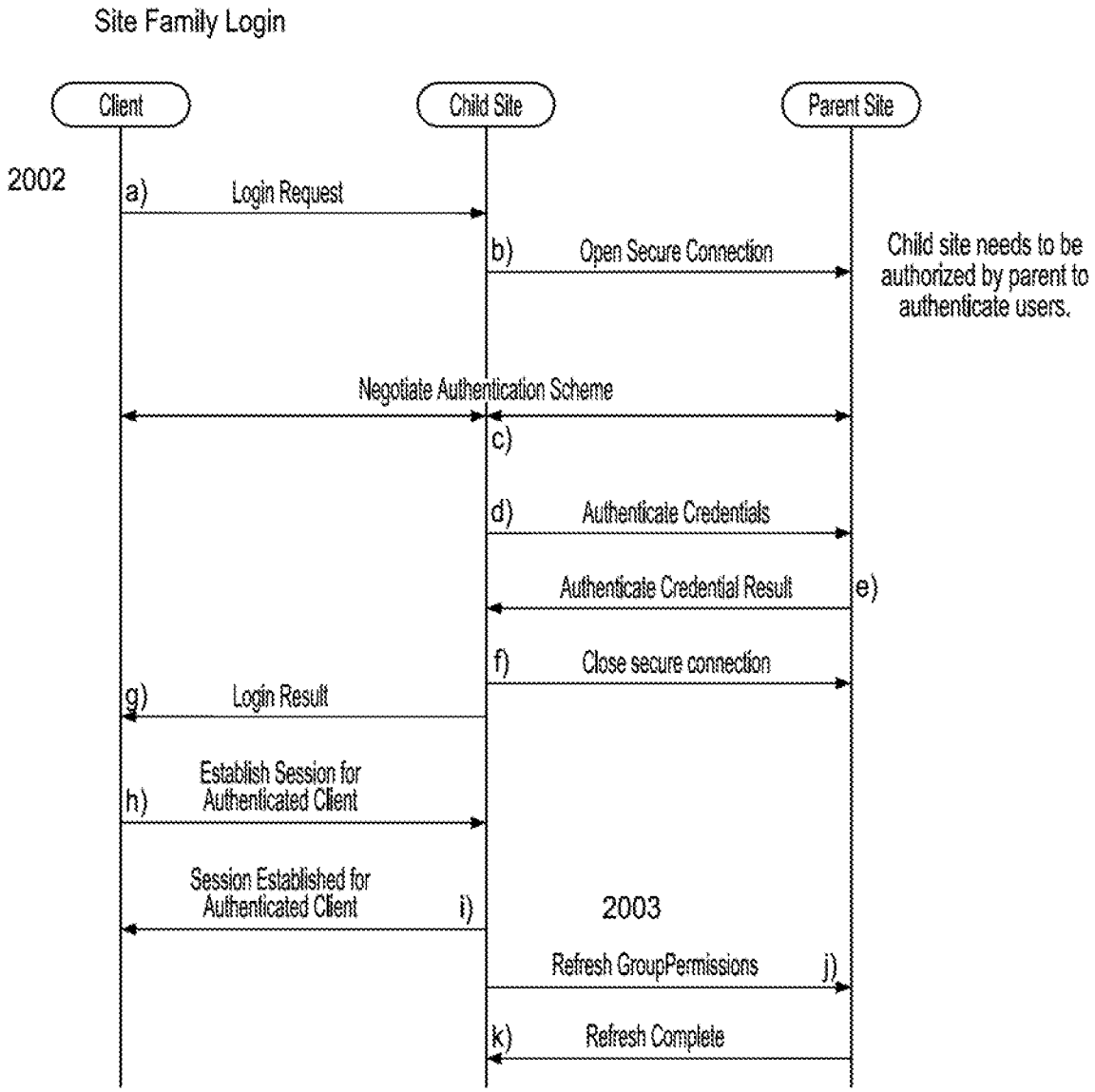
FIG. 20 is a message sequence chart that illustrates a remote authentication scheme employed by the child-site.

FIG. 20 is a message sequence that describes a remote authentication scheme employed by the child site of one embodiment.

In step A of FIG. 20, Credentials 2002 are entered by the user through a graphical interface on the client. The client opens a secure connection to the server and issues a request to child site to login using the provided credentials.

In step B of FIG. 20, if credentials 2002 are for a remotely synchronized user, the child site may open a secure and mutually authenticated connection to the parent.

In step C of FIG. 20, the client and parent site negotiate the authentication parameters that should be used to authenticate the user via the child.

In step D of FIG. 20, the child site accepts the authenticate parameters and credentials 2002 and sends the parameters and credentials to the parent site over the secure session.

In step E of FIG. 20, the parent performs the authentication task by verifying the credentials 2002 against the credentials stored in some backend user database.

In step F of FIG. 20, the child closes its connection to the parent once the parent has completed its authentication task.

In step G of FIG. 20, the child site returns the authentication result to the client.

In step H of FIG. 20, the authenticated client requests to establish a new session with the site.

In step I of FIG. 20, the child site accepts the authenticated client request to establish a session and generates authorization data 2003. The child site returns the authorization data 2003 to the client.

In step J of FIG. 20, the child site may refresh permissions for 2002 by initiating synchronization with the parent site after authenticating the credentials.

In step K of FIG. 20, the parent site serves the refresh request by returning the set of permissions for the user's group.

EMBODIMENTS

In one embodiment, a node comprises a processor and memory. The node further including computer-executable instructions stored in the memory of the node which, when executed by the processor of the node, cause the node to do actions. The actions may include adding a site as a child site to a parent site. Adding the site as a child site may include displaying a graphical user interface and receiving input at the graphical user interface and to add the site as the child site to the parent site.

The node may be part of a site, such as the parent site and child site, or may be at a remote client computer. The sites including the child site may be associated with surveillance cameras.

The control of the child site may be synchronized with the parent site. In one embodiment, users with the ability to manage the parent site may gain the ability or access to manage the child site but users with the ability to manage the child site will not gain the ability to manage the parent site. Ranked user and group privileges of the parent site may be pulled or pushed to the child site.

A child site may locally store a credential database for local users at the child site such that a local logon and authentication to the child site may be allowed, even when the parent site is unreachable. A child site may also authenticate the remote user against the parent site that stores credentials for remote users to allow the remote users to access at least one surveillance camera for the child site.

In one embodiment, a node includes a processor and memory. The node further including computer-executable instructions stored in the memory of the node which, when executed by the processor of the node, cause the node to do actions. The node may determine that the node is part of a child site. The child site includes multiple synchronized nodes. The node is associated with at least one camera. The node is synchronized with another node in a parent site.

The processor used in the foregoing embodiments may be, for example, a microprocessor, microcontroller, programmable logic controller, field programmable gate array, or an application-specific integrated circuit. Examples of computer readable media are non-transitory and include disc-based media such as CD-ROMs and DVDs, magnetic media such as hard drives and other forms of magnetic disk storage, semiconductor based media such as flash media, random access memory, and read only memory.

It is contemplated that any part of any aspect or embodiment discussed in this specification may be implemented or combined with any part of any other aspect or embodiment discussed in this specification.

For the sake of convenience, the exemplary embodiments above are described as various interconnected functional blocks. This is not necessary, however, and there may be cases where these functional blocks are equivalently aggregated into a single logic device, program or operation with unclear boundaries. In any event, the functional blocks may be implemented by themselves, or in combination with other pieces of hardware or software.

While particular embodiments have been described in the foregoing, it is to be understood that other embodiments are possible and are intended to be included herein. It will be clear to any person skilled in the art that modifications of and adjustments to the foregoing embodiments, not shown, are possible.

What is claimed:

1. A node comprising a processor and a memory, the node further including computer-executable instructions stored in the memory of the node which, when executed by the processor of the node, cause the node to:

display a first graphical user interface for a distributed security system, the distributed security system including the node and a plurality of other nodes, the first graphical user interface defining the logical and communicative organization of the node and the plurality of nodes;

receive input at the first graphical user interface to add a site as a child site of the distributed security system to a parent site of the distributed security system, wherein the parent site is associated with one or more credentials or configuration settings, and wherein neither the child site nor the parent site is a centralized server;

associate the one or more credentials or configuration settings from the parent site with the child site; and restrict access to modify the one or more credentials or configuration settings of the parent site from a second graphical user interface accessed through the child site.

2. The node of claim 1, wherein the node is part of the child site.

3. The node of claim 2, wherein the computer-executable instructions, when executed by the processor, further cause the node to synchronize the one or more credentials or configuration settings with the parent site.

4. The node of claim 2, wherein the first graphical user interface comprises a graphical representation of a network topology including at least the node associated with the child site and a second node associated with the parent site.

5. The node of claim 2, wherein the child site is configured to maintain membership information of the child site independently of the parent site.

6. The node of claim 5, wherein the membership information comprises user credentials, rank, and privileges associated with at least one user.

7. The node of claim 5, wherein the node and at least one of the other nodes are part of the child site, and wherein each of the node and the at least one of the other nodes is configured to:

store the one or more credentials or configuration settings for the child site; and synchronize the one or more credentials or configuration settings with the other of the node or the at least one of the other nodes.

8. The node of claim 1, wherein at least one of the child site or the parent site is configured to synchronize user credentials with an external service.

9. The node of claim 1, wherein the computer-executable instructions, when executed by the processor, further cause the node to share at least a view or a camera image with the parent site.

10. The node of claim 1, wherein the computer-executable instructions, when executed by the processor, further cause the node to stream video data through another node to the parent site.

11. The node of claim 1, wherein the computer-executable instructions, when executed by the processor, further cause the node to share real-time system event and alert information with the parent site.

12. The node of claim 1, wherein the node comprises a client device.

13. The node of claim 1, wherein the first graphical user interface and the second graphical user interface are generated by the parent site.

14. The node of claim 1, wherein the parent site is at a higher organizational level than the child site.

15. The node of claim 14, wherein the one or more settings include credentials of users with access to all sites, and wherein the computer-executable instructions, when executed by the processor, further cause the node to restrict access to the credentials through the child site.

16. The node of claim 14, wherein the parent site has a first rank and the child site has a second rank, wherein the second rank is equal to or less than the first rank, and wherein the first rank and the second rank determine access to the parent site and the child site.

17. A distributed security system comprising:

a memory storing computer-executable instructions;

a plurality of nodes including a first node and a plurality of other nodes, the first node including a processor in communication with the memory to receive the computer-executable instructions which, when executed by the processor of the first node, cause the first node to:

display a first graphical user interface for the distributed security system, the first graphical user interface defining the logical and communicative organization of the first node and the plurality of nodes;

receive input at the first graphical user interface to add a site as a child site of the distributed security system to a parent site of the distributed security system, wherein the parent site is associated with one or more credentials or configuration settings, and wherein neither the child site nor the parent site is a centralized server;

associate the one or more credentials or configuration settings from the parent site with the child site; and restrict access to modify the one or more credentials or configuration settings of the parent site from a second graphical user interface accessed through the child site.

18. The distributed security system of claim 17, wherein the first node is part of the child site.

19. The distributed security system of claim 18, wherein the computer-executable instructions, when executed by the processor, further cause the first node to synchronize the one or more credentials or configuration settings with the parent site.

20. The distributed security system of claim 18, wherein the first graphical user interface comprises a graphical representation of a network topology including at least the first node associated with the child site and a second node associated with the parent site.

21. The distributed security system of claim 18, wherein the child site is configured to maintain membership information of the child site independently of the parent site.

22. The distributed security system of claim 21, wherein the membership information comprises user credentials, rank, and privileges associated with at least one user.

23. The distributed security system of claim 21, wherein the first node and at least one of the other nodes are part of the child site, and wherein each of the first node and the at least one of the other nodes is configured to:

store the one or more credentials or configuration settings for the child site; and synchronize the one or more credentials or configuration settings with the other of the first node or the at least one of the other nodes.

24. The distributed security system of claim 17, wherein at least one of the child site or the parent site is configured to synchronize user credentials with an external service.

25. The distributed security system of claim 17, wherein the computer-executable instructions, when executed by the processor, further cause the first node to share at least a view or a camera image with the parent site.

26. The distributed security system of claim 17, wherein the computer-executable instructions, when executed by the processor, further cause the first node to stream video data through another node to the parent site.

27. The distributed security system of claim 17, wherein the computer-executable instructions, when executed by the processor, further cause the first node to share real-time system event and alert information with the parent site.

28. The distributed security system of claim 17, wherein the first node comprises a client device.

29. The distributed security system of claim 17, wherein the first graphical user interface and the second graphical user interface are generated by the parent site.

* * * * *